US009310713B2

(12) United States Patent
Maeshima et al.

(10) Patent No.: US 9,310,713 B2
(45) Date of Patent: Apr. 12, 2016

(54) DEVELOPER CONTAINER, DEVELOPING DEVICE, PROCESS CARTRIDGE, AND IMAGE FORMING APPARATUS

(71) Applicant: CANON KABUSHIKI KAISHA, Tokyo (JP)

(72) Inventors: Hideki Maeshima, Mishima (JP); Kuniaki Hirukawa, Yokohama (JP); Shuichi Gofuku, Numazu (JP); Shuhei Kawasaki, Susono (JP); Hisashi Taniguchi, Suntou-gun (JP); Kodai Hayashi, Suntou-gun (JP); Yoshihiro Mitsui, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/656,467

(22) Filed: Mar. 12, 2015

(65) Prior Publication Data

US 2015/0261131 A1 Sep. 17, 2015

(30) Foreign Application Priority Data

Mar. 14, 2014 (JP) ..... 2014-052325
Mar. 31, 2014 (JP) ..... 2014-074543
Jan. 14, 2015 (JP) ..... 2015-004825

(51) Int. Cl.
*G03G 15/08* (2006.01)

(52) U.S. Cl.
CPC ..... *G03G 15/0831* (2013.01); *G03G 15/0865* (2013.01)

(58) Field of Classification Search
CPC ..... G03G 15/0831; G03G 15/0865; G03G 15/0822
See application file for complete search history.

(56) References Cited

U.S. PATENT DOCUMENTS

| | | | | |
|---|---|---|---|---|
| 6,026,263 | A * | 2/2000 | Nakahata et al. | 399/263 |
| 8,036,543 | B2 * | 10/2011 | Yokomori et al. | 399/27 |
| 8,208,838 | B2 * | 6/2012 | Kakuta et al. | 399/262 |
| 8,380,105 | B2 * | 2/2013 | Kakuta et al. | 399/111 |
| 2013/0129390 | A1 * | 5/2013 | Kakuta et al. | 399/258 |
| 2014/0079415 | A1 * | 3/2014 | Fukasawa et al. | 399/27 |

FOREIGN PATENT DOCUMENTS

| | | | |
|---|---|---|---|
| JP | 2003-131479 | A | 5/2003 |
| JP | 2003-167490 | A | 6/2003 |
| JP | 2008-209897 | A | 9/2008 |
| JP | 2011-253203 | A | 12/2011 |

* cited by examiner

*Primary Examiner* — Rodney Bonnette
(74) *Attorney, Agent, or Firm* — Canon USA Inc. IP Division

(57) ABSTRACT

In a developer container or the like, developer is conveyed efficiently by utilizing a projecting portion included in a transmitting member and another projecting portion. A velocity vector that is generated at a free end of a conveying member and is oriented upward becomes largest during a period from when the conveying member having been in contact with the projecting portion is released from the projecting portion until when the free end of the conveying member comes into contact with a storage chamber.

25 Claims, 23 Drawing Sheets

DEVELOPER CONTAINER, DEVELOPING DEVICE, PROCESS CARTRIDGE, AND IMAGE FORMING APPARATUS

BACKGROUND OF THE INVENTION

1. Field of the Invention

The present invention relates to the conveyance of developer. In particular, the present invention relates to an electrophotographic image forming apparatus including a process cartridge and is suitable for an electrophotographic color-image-forming apparatus.

Herein, the term "electrophotographic image forming apparatus" refers to an apparatus that forms an image on a recording medium by an electrophotographic image forming method. Exemplary electrophotographic image forming apparatuses include an electrophotographic copier, an electrophotographic printer (such as a laser beam printer and a light-emitting-diode (LED) printer), a facsimile apparatus, and a word processor.

The term "process cartridge" refers to a cartridge including a charging device, a developing portion, a cleaning device, and an image bearing member. The cartridge is attachable to and detachable from a main body of the electrophotographic image forming apparatus. The process cartridge attachable to and detachable from the body of the electrophotographic image forming apparatus may be a cartridge unit including an image bearing member and at least one of the charging device, the developing portion, and the cleaning device.

The term "developing device" refers to a unit attachable to and detachable from the main body of an image forming apparatus and including a developing portion that develops a latent image on an image bearing member, a developing-portion frame that supports the developing portion, and other components associated with the developing portion. The developing device is also referred to as developing cartridge or developing unit, according to need.

The term "developer container" refers to a container that stores developer to be used in an electrophotographic image forming process and includes a conveying device that conveys the developer stored therein, and so forth.

2. Description of the Related Art

In a known image forming apparatus employing an electrophotographic image forming process, a cartridge system is employed in which cartridges such as a developing cartridge and a process cartridge are attachable to and detachable from the body of the image forming apparatus. Such a cartridge system may have a function of indicating the remaining number of printable pages so that the user can replace the cartridge with a new one at an appropriate timing. To add such a function to the cartridge system, the amount of developer remaining in the cartridge needs to be detected or estimated. To do so, several methods have already been proposed.

One of those proposed methods is a light-transmission remaining-developer-amount-detecting method. In this method, an optical path passing through a developer chamber is provided between a light-emitting device such as an LED and a light-receiving device such as a phototransistor that are attached to the body or any other component of the image forming apparatus, and the remaining amount of developer is calculated from how long the developer has blocked light.

In an exemplary light-transmission remaining-developer-amount-detecting method (disclosed by Japanese Patent Laid-Open No. 2003-131479), an emission-side light-guiding member and a reception-side light-guiding member are provided to a developer container unit so as to guide detecting light into a developer chamber. The emission-side light-guiding member guides the detecting light, emitted from a light-emitting device such as an LED, into the developer chamber. The reception-side light-guiding member guides the detecting light that has been transmitted through the developer chamber toward a light-receiving device, such as a phototransistor, provided on the outside of the developer chamber.

In another exemplary method (disclosed by Japanese Patent Laid-Open No. 2003-167490), a light-guiding member as a unit including an emission-side light-guiding member and a reception-side light-guiding member is provided in a longitudinal central area of a developer chamber.

Furthermore, a known developing device includes a development chamber and a developer chamber. In the development chamber, a developer bearing member for supplying developer to a photosensitive drum and a developer supplying member for supplying the developer to the developer bearing member are provided. The developer to be supplied to the development chamber is stored in the developer chamber. In such a device, the developer chamber is positioned below the development chamber in the gravitational direction. Therefore, the developer needs to be conveyed against the gravitational force.

There are some known methods of conveying developer from a developer chamber to a development chamber provided above the developer chamber. In one of those methods, the developer is conveyed with a rotational motion of a flexible sheet. Another method employs a sheet member that conveys developer from a developer chamber to a development chamber while passing two positions: a deformation position where the sheet member is elastically deformed while being in contact with the sidewall of the developer chamber, and a restoration position where the elastically deformed sheet member is released. In each of the methods, the developer is conveyed by utilizing a force (restoring force) generated when the sheet member that has been deformed restores its original form (see Japanese Patent Laid-Open No. 2011-253203 and Japanese Patent Laid-Open No. 2008-209897).

In such known proposals, however, to reduce the size of the cartridge, the light-guiding members are provided on the upstream side with respect to the boundary between the deformation position and the restoration position in the direction of rotation of the sheet member. Furthermore, the light-guiding members include protrusions provided on the sidewall of the developer chamber. Therefore, when the sheet member, which is carrying the developer, goes over the protrusions of the light-guiding members, some of the developer may fall off the sheet member at the contact with the protrusions, and the amount of developer on the sheet member that is to be conveyed to the development chamber may be reduced. That is, the amount of developer on the sheet member may be reduced before the sheet member passes the boundary between the deformation position and the restoration position.

SUMMARY OF THE INVENTION

According to a first aspect of the present invention, there is provided a developer container including a storage chamber that stores developer, a conveying member provided in the storage chamber and configured to convey the developer, a transmitting member configured to transmit a signal for detecting an amount of developer, and a first projecting portion provided on an inner sidewall of the storage chamber, the first projecting portion projecting toward a conveying-member shaft of the conveying member when seen in a longitudinal direction of the storage chamber and being different from the transmitting member. The transmitting member includes a second projecting portion projecting from the inner sidewall of the storage chamber toward the conveying-member shaft of the conveying member when seen in the longitudinal direction of the storage chamber. The conveying member is deformed elastically by coming into contact with one of the first projecting portion and the second projecting portion while being in contact with the other projecting portion by which the conveying member has already been elastically deformed, or the conveying member is deformed elastically by simultaneously coming into contact with the first projecting portion and the second projecting portion.

According to a second aspect of the present invention, there is provided a developer container including a storage chamber that stores developer, a development chamber into which the developer is supplied from the storage chamber through an opening, a conveying member provided in the storage chamber and configured to convey the developer, and a projecting portion projecting from an inner sidewall of the storage chamber toward a rotating-shaft side of the conveying member when seen in a longitudinal direction of the storage chamber. A free end of the conveying member comes into contact with a wall of the storage chamber when positioned on a downstream side with respect to the projecting portion and on an upstream side with respect to the opening in a direction of rotation of the conveying member. The conveying member bends by coming into contact with the projecting portion and conveys the developer when being released from the projecting portion. A velocity vector at a free end of the conveying member and in a direction opposite to a gravitational direction becomes largest during a period after the free end that has been bent is released from the projecting portion and before the free end comes into contact with the storage chamber.

According to a third aspect of the present invention, there is provided a developing device, a process cartridge, or an image forming apparatus.

Further features of the present invention will become apparent from the following description of exemplary embodiments with reference to the attached drawings.

DESCRIPTION OF THE EMBODIMENTS

First Embodiment

An image forming apparatus and a process cartridge according to a first embodiment of the present invention will now be described with reference to the accompanying drawings.

1. Overall Configuration of Image Forming Apparatus

Figure 2:
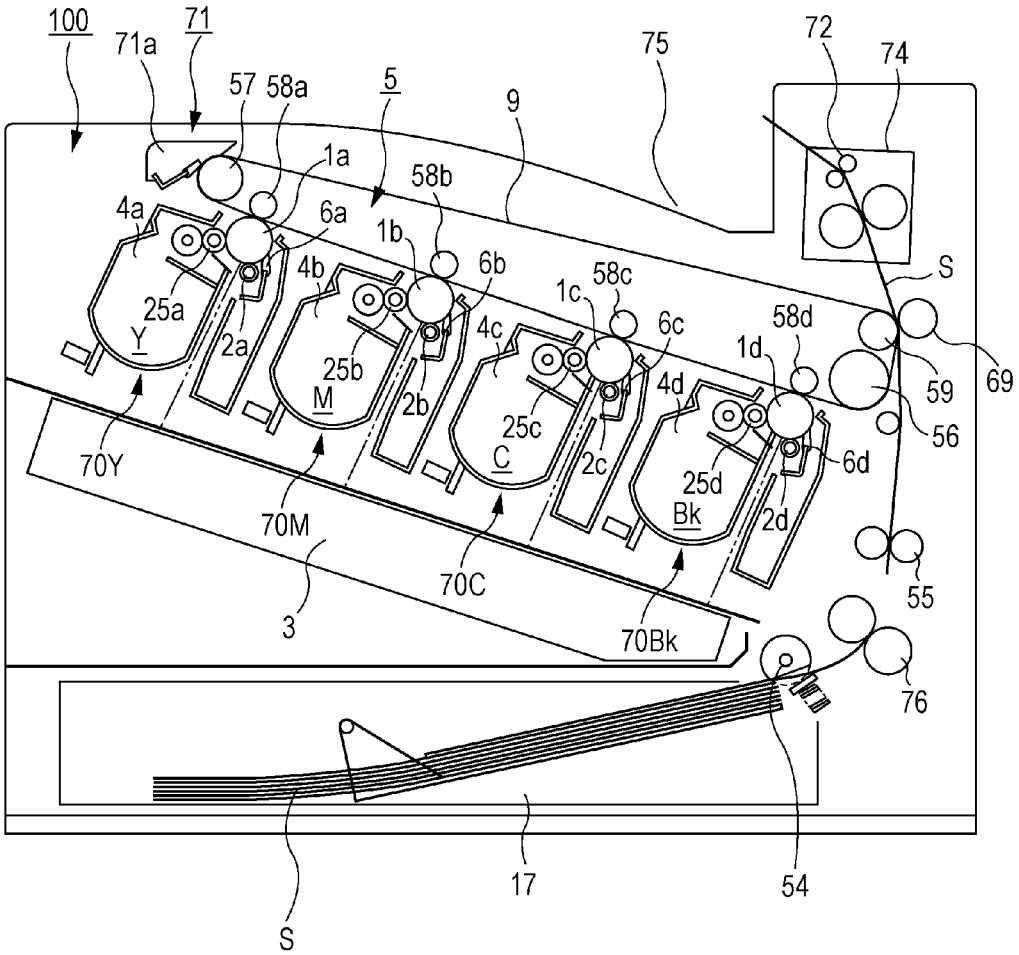
FIG. 2 illustrates a configuration of an electrophotographic image forming apparatus according to the first embodiment in which process cartridges are set.

An overall configuration of an electrophotographic image forming apparatus (hereinafter referred to as image forming apparatus) 100 will first be described with reference to FIG. 2. The image forming apparatus 100 according to the first embodiment is a full-color laser printer employing an in-line method and an intermediate transfer method. The image forming apparatus 100 is capable of forming a full-color image on a recording medium (such as recording paper, plastic sheet, and cloth) on the basis of image information. The image information is inputted to the image forming apparatus 100 from an image reading apparatus connected to the image forming apparatus 100. The image information is inputted to the image forming apparatus 100 from a host apparatus, such as a personal computer, communicably connected to the image forming apparatus 100. As illustrated in FIG. 2, four detachable process cartridges 70 (70Y, 70M, 70C, and 70K) are attached to the body of the image forming apparatus 100 with attaching members (not illustrated). The process cartridges 70 are attached to the body of the image forming apparatus 100 from a lateral side of the image forming apparatus 100. Herein, the direction of attaching is defined as the direction perpendicular to the plane of the page of FIG. 2. Specifically, the upstream side in the direction of attaching is defined as the proximal lateral side, and the downstream side in the direction of attaching is defined as the distal lateral side. Furthermore, the lateral direction and the vertical direction in FIG. 2 are defined as the horizontal direction and the gravitational direction, respectively. In FIG. 2, the process cartridges 70 in the body of the image forming apparatus 100 are arranged in a line that is inclined with respect to the horizontal direction. The term "the body of the image forming apparatus 100" refers to a portion of the image forming apparatus 100 excluding at least the process cartridge 70. The image forming apparatus 100 may be configured such that each developing device alone is detachable from the body thereof. In that case, the term "the body of the image forming apparatus 100" refers to a portion of the image forming apparatus 100 excluding the developing device.

The process cartridges 70 each include an electrophotographic photosensitive drum (hereinafter referred to as photosensitive drum) 1 (1*a*, 1*b*, 1*c*, or 1*d*) as an image bearing member, around which a charging roller 2 (2*a*, 2*b*, 2*c*, or 2*d*) as a charging device, a developing roller 25 (25*a*, 25*b*, 25*c*, or 25*d*) as a developer bearing member, a cleaning member 6 (6*a*, 6*b*, 6*c*, or 6*d*) as a cleaning device, and other associated elements are provided as a unit of processing devices. The charging roller 2 uniformly charges the surface of the photosensitive drum 1. The developing roller 25 develops and visualizes, with developer, a latent image formed on the photosensitive drum 1. The cleaning member 6 removes the developer (hereinafter referred to as toner) remaining on the photosensitive drum 1 after the developer image (i.e., a toner image) on the photosensitive drum 1 is transferred to a recording medium.

A scanner unit 3 is provided below the process cartridges 70. The scanner unit 3 is an exposure device that selectively exposes each photosensitive drum 1 to light on the basis of the image information and thus forms a latent image on the photosensitive drum 1.

A cassette 17 storing recording media S is provided at the bottom of the body of the image forming apparatus 100. A recording-medium-conveying device is provided such that each of the recording media S is conveyed past a secondary transfer roller 69 and a fixing unit 74 to the top of the body of the image forming apparatus 100. The recording-medium-conveying device includes a feed roller 54 that separates one of the recording media S in the cassette 17 from the others and feeds out the recording medium S, a pair of conveying rollers 76 that convey the thus fed recording medium S, and a pair of registration rollers 55 that synchronize the formation of latent images on the photosensitive drums 1 and the conveyance of the recording medium S. An intermediate transfer unit 5 as an intermediate transfer device to which the toner images on the respective photosensitive drums 1 are transferred is provided above the process cartridges 70. The intermediate transfer unit 5 includes a driving roller 56, a follower roller 57, primary transfer rollers 58 (58*a*, 58*b*, 58*c*, and 58*d*) provided at positions facing the respective photosensitive drums 1 provided for different colors, a counter roller 59 facing the secondary transfer roller 69, and a transfer belt 9 stretched around the foregoing rollers. The transfer belt 9 rotates while being in contact with all of the photosensitive drums 1. A voltage is applied to the primary transfer rollers 58, whereby the toner images are transferred, for primary transfer, from the photosensitive drums 1 to the transfer belt 9. Subsequently, voltages are applied to the counter roller 59 provided on the inner side of the transfer belt 9 and to the secondary transfer roller 69, whereby the toner images on the transfer belt 9 are transferred to the recording medium S. Toner remaining on the transfer belt 9 after the transfer is scraped from the transfer belt 9 by a blade included in a collecting device 71 and is collected into a waste toner container 71*a*.

To form an image, the photosensitive drums 1 are rotated and are uniformly charged by the respective charging rollers 2, and the photosensitive drums 1 are selectively exposed to light emitted from the scanner unit 3, whereby electrostatic latent images are formed on the respective photosensitive drums 1. Then, the electrostatic latent images are developed by the respective developing roller 25. Thus, toner images in the respective colors are formed on the respective photosensitive drums 1. Synchronously with the above image forming operation, the pair of registration rollers 55 convey the recording medium S to a secondary transfer position where the counter roller 59 and the secondary transfer roller 69 are in contact with each other with the transfer belt 9 interposed therebetween. Then, a transfer bias voltage is applied to the secondary transfer roller 69, whereby the toner images in the respective colors on the transfer belt 9 are transferred to the recording medium S for secondary transfer. Thus, a color image is formed on the recording medium S. The recording medium S carrying the color image is subjected to heat and pressure applied by the fixing unit 74, whereby the color image is fixed. Subsequently, the recording medium S is discharged to a discharge portion 75 by a pair of discharge rollers 72. The fixing unit 74 is provided at the top of the body of the image forming apparatus 100.

2. Process Cartridge

Figure 3:
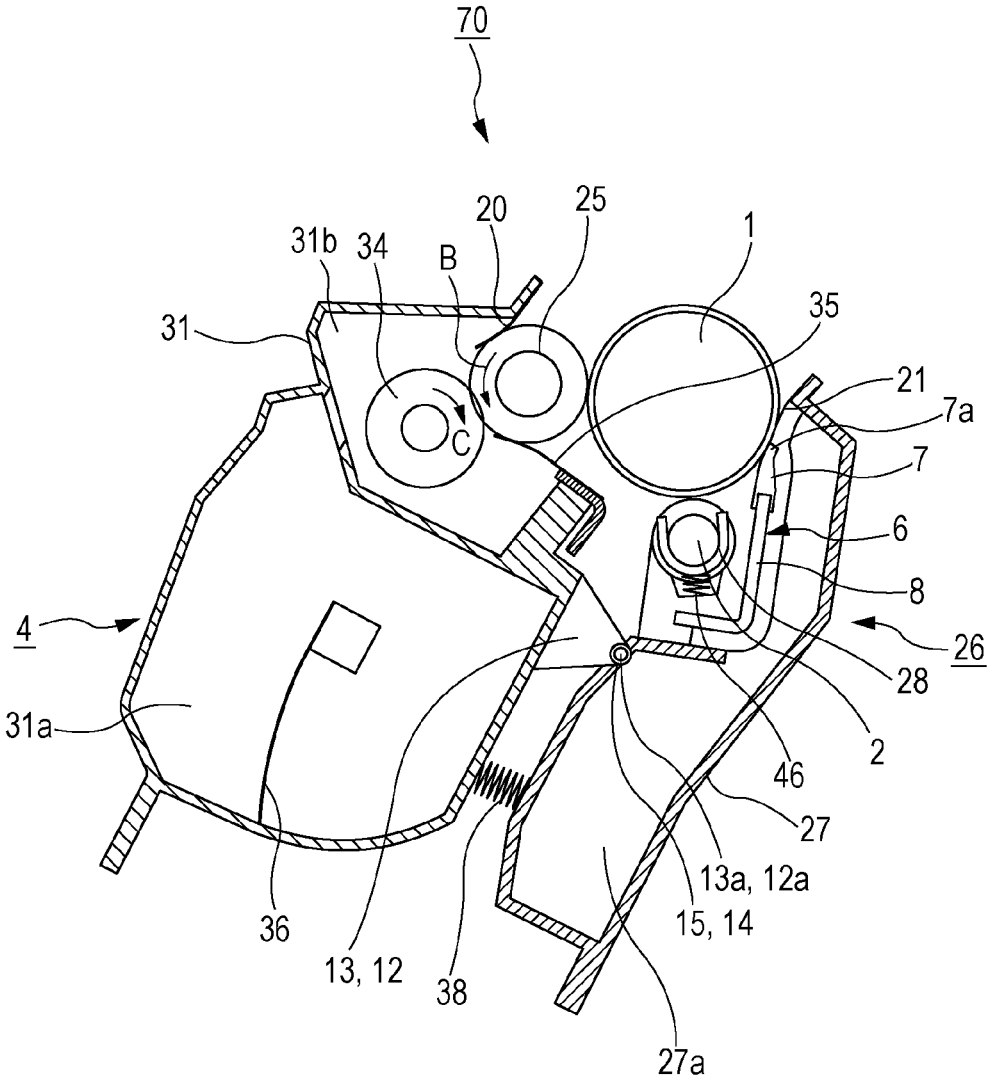
FIG. 3 illustrates one of the process cartridges according to the first embodiment.

The process cartridge 70 will now be described with reference to FIG. 3. FIG. 3 illustrates a major section of the process cartridge 70 that contains toner. In the first embodiment, a cartridge 70Y containing a yellow-colored toner, a cartridge 70M containing a magenta-colored toner, a cartridge 70C containing a cyan-colored toner, and a cartridge 70K containing a black-colored toner all have the same configuration. However, all the process cartridges 70 do not necessarily have the same configuration. For example, the cartridge 70K containing the black-colored toner may have a larger size or capacity than the others.

The process cartridge 70 includes a cleaning unit 26 and a developing unit 4. The cleaning unit 26 includes the photosensitive drum 1 as an image bearing member, the charging roller 2 as a charging device, and the cleaning member 6 as a cleaning device. The developing unit 4 includes the developing roller 25 as a developer bearing member.

The cleaning unit 26 and the developing unit 4 are rotatable with respect to each other, with pins (15, 14) fitted in respective pin holes (13*a*, 12*a*) provided in shaft portions (13, 12) provided at two respective ends of the developing unit 4. The cleaning unit 26 and the developing unit 4 are rotatable about the pins 15 and 14 with a pressing force exerted by a spring 38. In this state, the photosensitive drum 1 and the developing roller 25 are pressed against each other.

As described above, the charging roller 2 and the cleaning member 6 are provided in contact with the circumference of the photosensitive drum 1. The cleaning member 6 includes an elastic member 7, which is a rubber blade, and an elastic-member-supporting member 8. A tip 7*a* of the elastic member 7 is in contact with the photosensitive drum 1 while extending in a direction opposite to the direction of rotation of the photosensitive drum 1. Residual toner removed from the surface of the photosensitive drum 1 by the cleaning member 6 falls into a removed toner chamber 27*a*. A scooping sheet 21 that prevents the removed toner in the removed toner chamber 27*a* from leaking is provided in contact with the photosensitive drum 1. When a driving force generated by a body-side driving motor (not illustrated) as a drive source is transmitted to the cleaning unit 26, the photosensitive drum 1 rotates in accordance with the image forming operation. The charging roller 2 is rotatably attached to the cleaning unit 26 with a charging roller bearing 28 interposed therebetween. The charging roller 2 is pressed against the photosensitive drum 1 by a charging-roller-pressing member 46 and thus rotates with the rotation of the photosensitive drum 1.

3. Developing Unit and Toner Conveying Device

As illustrated in FIG. 3, the developing unit 4 according to the first embodiment includes the developing roller 25 that is rotatable in a direction of arrow B while being in contact with the photosensitive drum 1, and a developing-unit frame 31 that supports the developing roller 25. The developing roller 25 is rotatably supported by the developing-unit frame 31 with a front bearing and a rear bearing at two respective ends of the developing-unit frame 31 interposed therebetween. A toner supplying roller 34 and a toner blade 35 are provided in contact with the circumference of the developing roller 25. The toner supplying roller 34 as a developer supplying member rotates in a direction of arrow C while being in contact with the developing roller 25. The toner blade 35 as a regulating member regulates the thickness of a layer of toner on the developing roller 25. A leakage preventing sheet 20 as a developing-roller contact sheet is provided in contact with the developing roller 25 and prevents the leakage of toner from the developing-unit frame 31. A toner conveying member 36 is provided in a toner chamber 31*a* defined by the developing-unit frame 31. The toner conveying member 36 stirs the toner in the toner chamber 31*a* and conveys the toner to the toner supplying roller 34.

Figure 4:
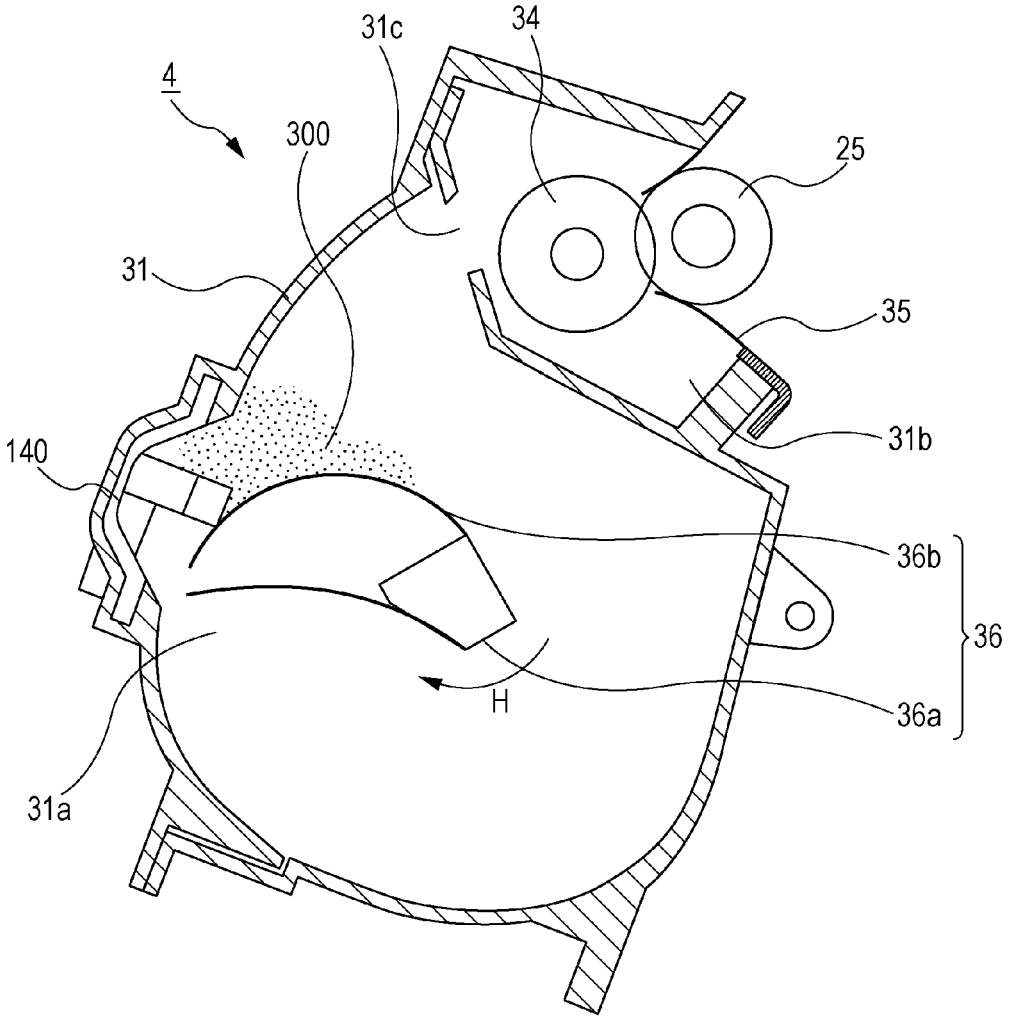
FIG. 4 illustrates a developing unit according to the first embodiment.

As illustrated in FIG. 4, the toner conveying member 36 includes a stirring shaft 36*a* including a rotating shaft (conveying-member shaft) rotatable with a driving force supplied from the outside, and a sheet member 36*b* attached to the stirring shaft 36*a* and rotating with the stirring shaft 36*a*. A portion 140 of a remaining-amount-detecting device that detects the amount of toner remaining in the toner chamber 31*a* is provided on a sidewall of the toner chamber 31*a*.

Figure 5:
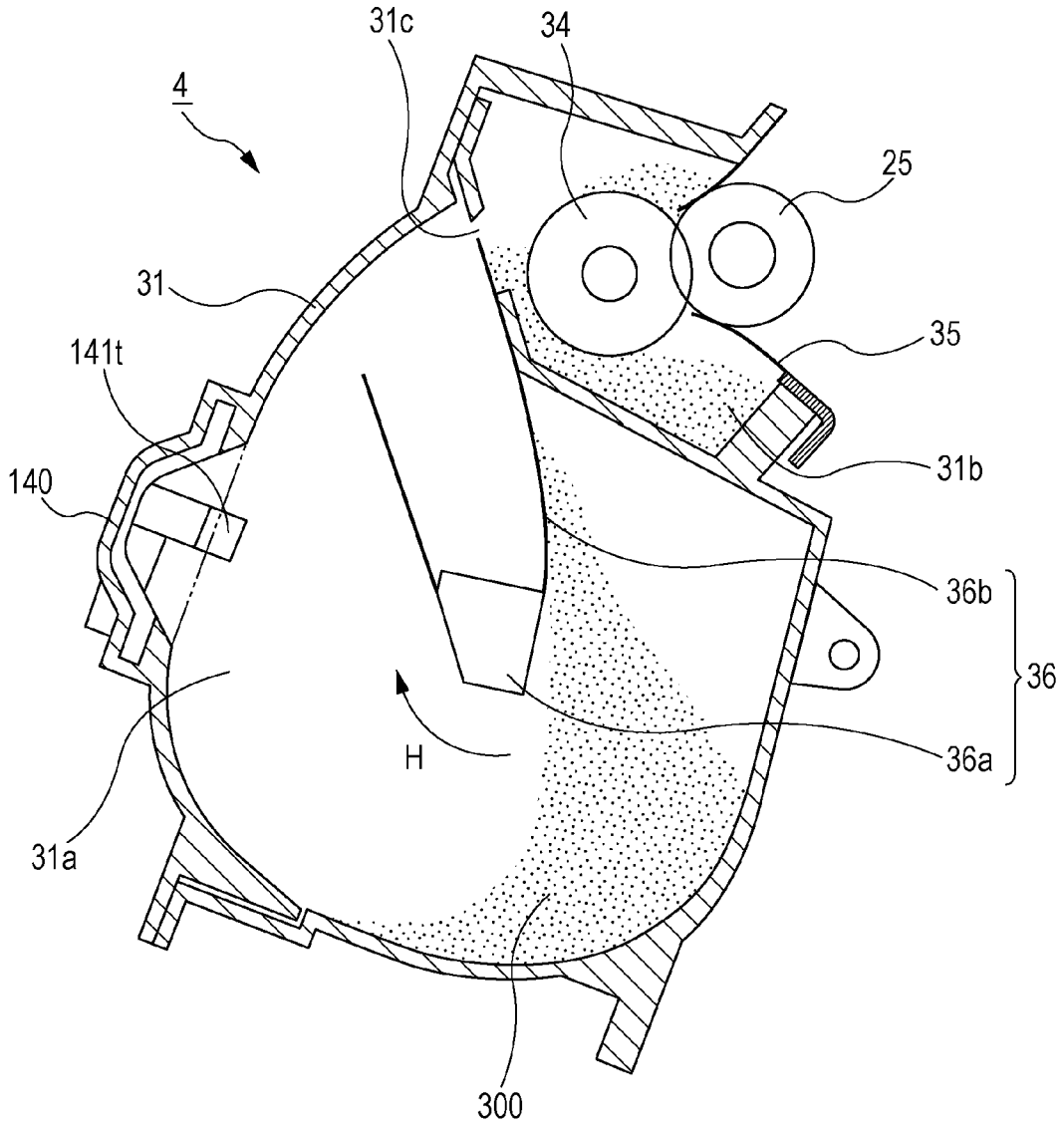
FIG. 5 illustrates an operation of supplying toner into a development chamber according to the first embodiment.

The conveyance of toner performed in the developing unit 4 will now be described. As illustrated in FIG. 4, when the toner conveying member 36 rotates (in a direction of arrow H), toner 300 is pushed and moved by the sheet member 36*b*. When the toner conveying member 36 further rotates, the toner 300 is lifted by the sheet member 36*b*, as illustrated in FIG. 5, and is conveyed to the toner supplying roller 34 provided in a development chamber 31*b*. In this process, some of the toner 300 falls into the toner chamber 31*a* and accumulates at the bottom of the toner chamber 31*a*, that is, the toner 300 returns to the initial position. With the repetition of this cycle, the toner 300 is stirred and conveyed.

The toner 300 that has been supplied into the toner supplying roller 34 provided in the development chamber 31*b* is used for the development of the latent image on the photosensitive drum 1 that is performed by the developing portion as described above.

4. Remaining-Amount-Detecting Device

The remaining-amount-detecting device provided to the toner chamber 31*a* will now be described with reference to FIGS. 5 to 11.

The description starts with a light-guiding member 141 as a transmitting member included in the portion 140 of the remaining-amount-detecting device illustrated in FIG. 5.

Figure 6:
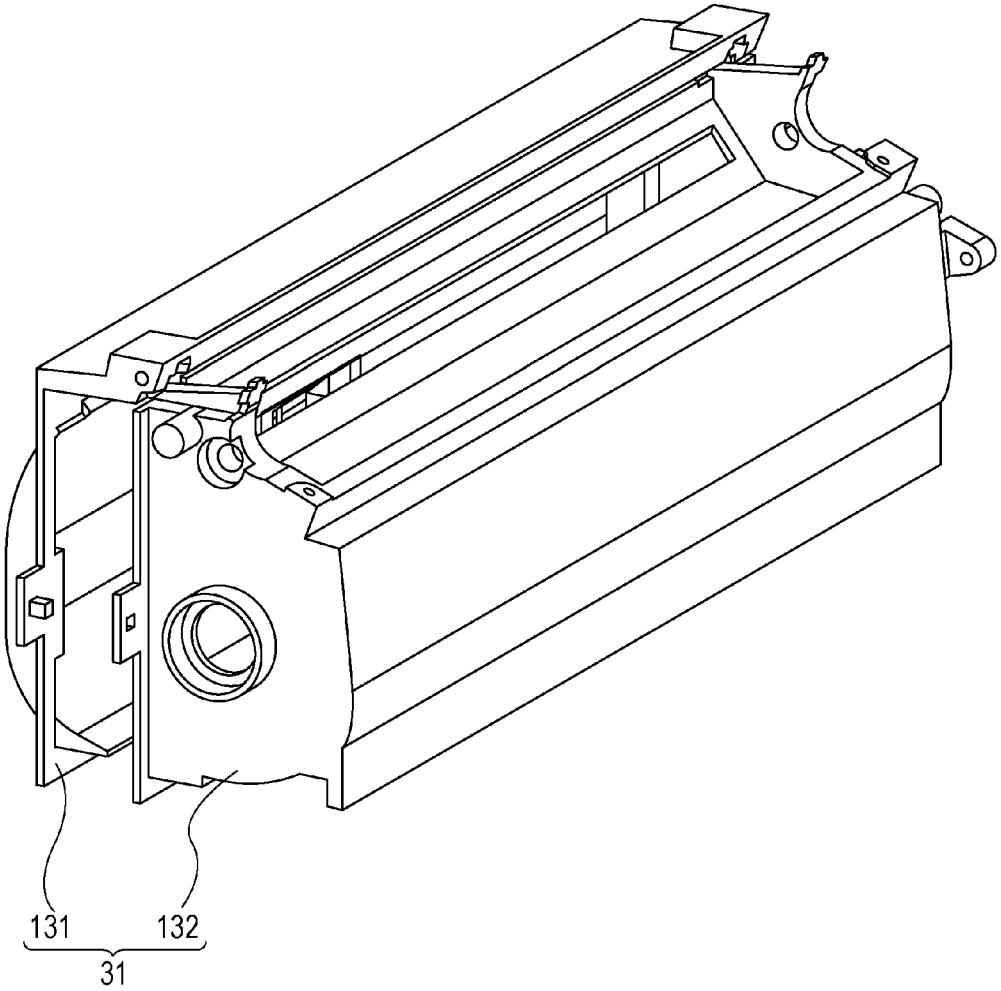
FIG. 6 illustrates a configuration of the developing unit according to the first embodiment.
Figure 7:
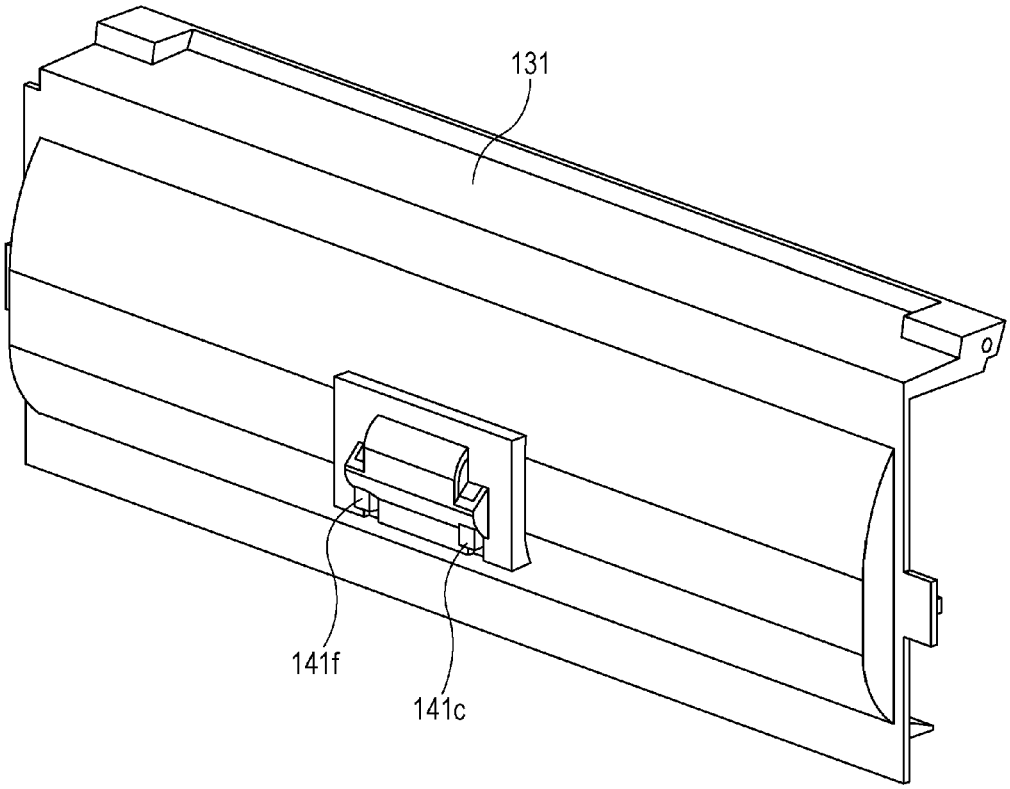
FIG. 7 is an external view illustrating a part of a remaining-amount-detecting device according to the first embodiment.
Figure 8:
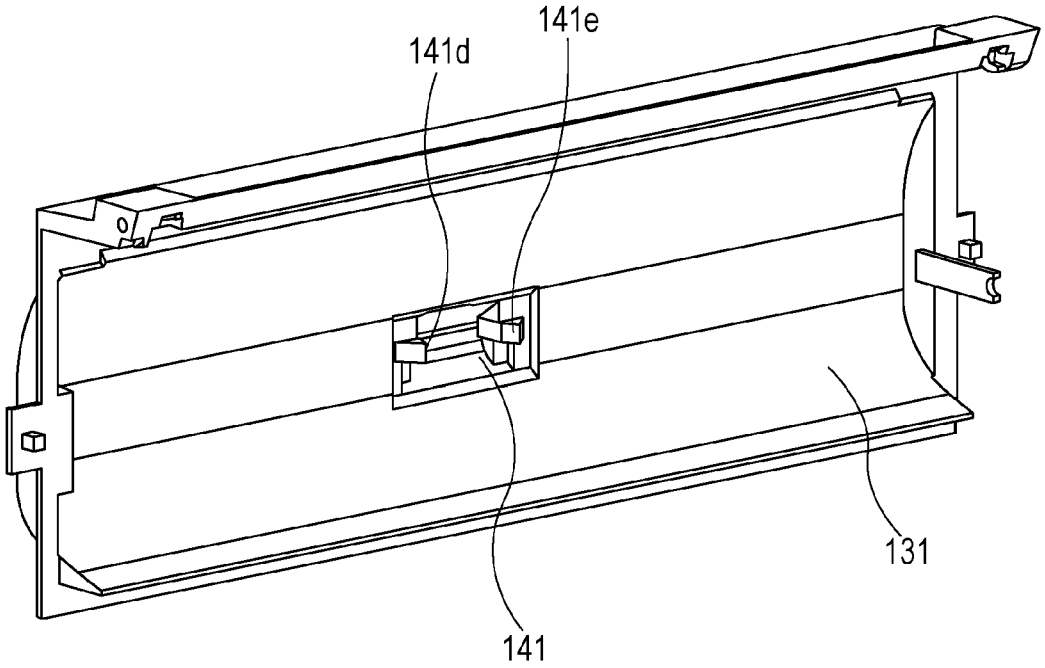
FIG. 8 illustrates a part of the remaining-amount-detecting device according to the first embodiment that is seen from the inner side of a toner chamber.
Figure 9:
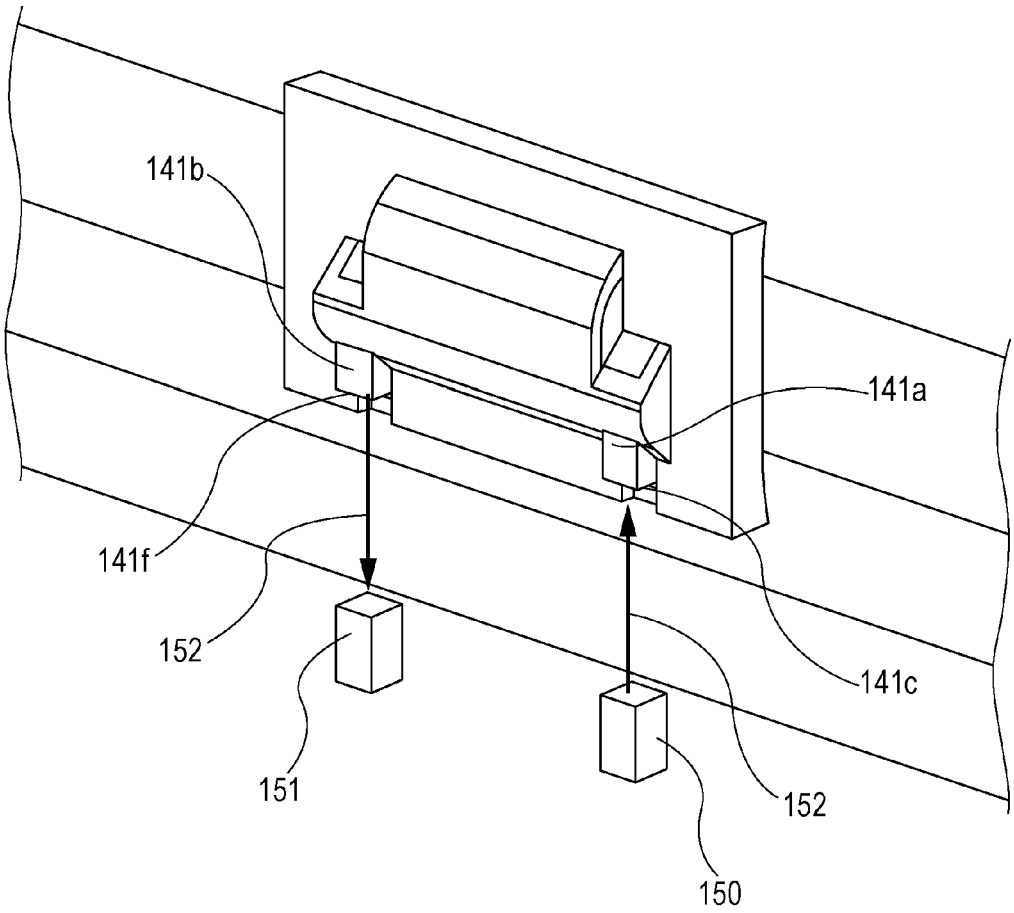
FIG. 9 illustrates the remaining-amount-detecting device according to the first embodiment.
Figure 10:
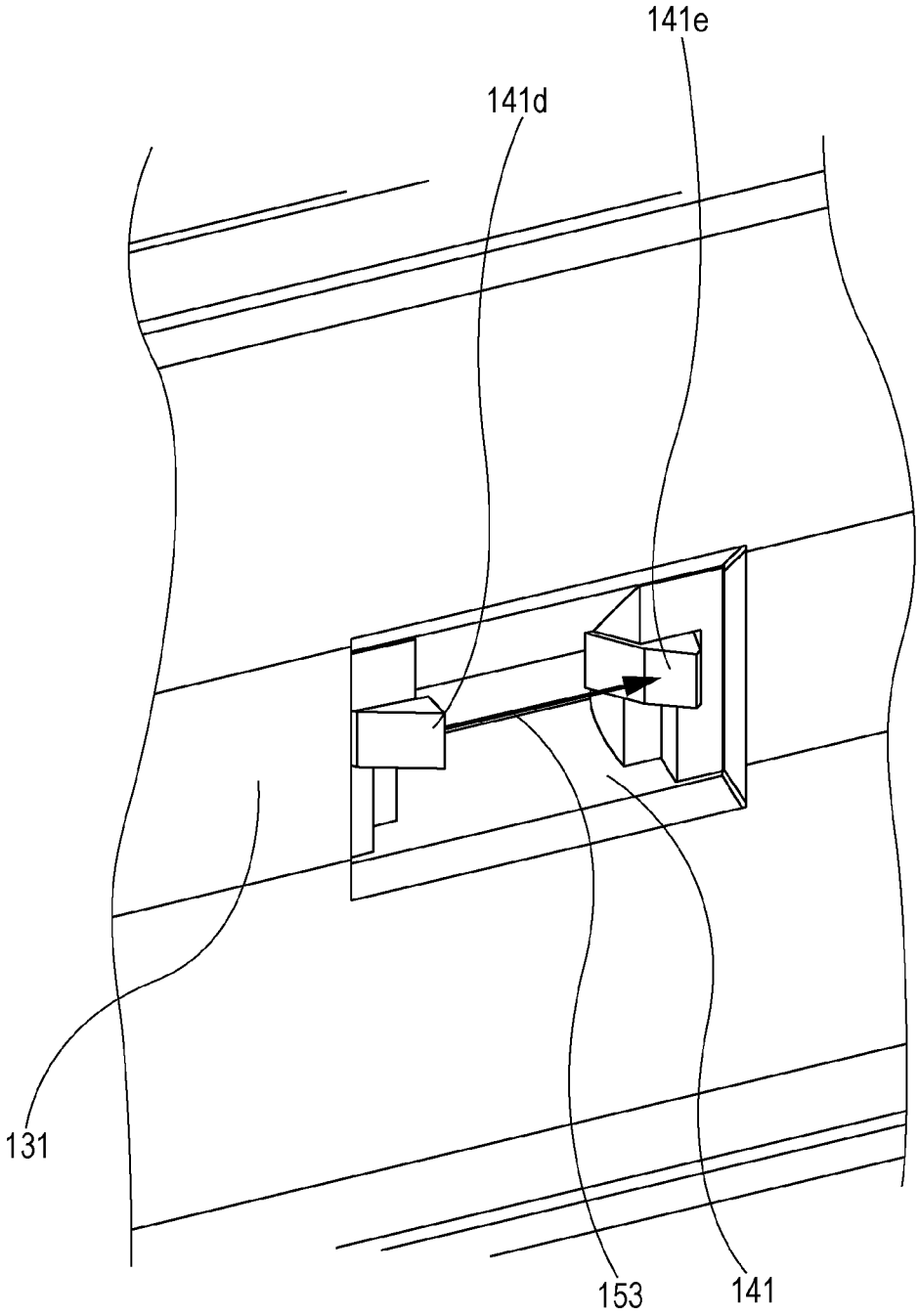
FIG. 10 illustrates the remaining-amount-detecting device according to the first embodiment.

As illustrated in FIG. 6, the developing-unit frame 31 (corresponding to a developer container) is a combination of a first developing-unit frame 131 and a second developing-unit frame 132 that are joined to each other by ultrasonic welding or the like. The light-guiding member 141 is attached to the first developing-unit frame 131. FIGS. 7 and 8 illustrate the outer side and the inner side, respectively, of the first developing-unit frame 131 provided with the light-guiding member 141. FIGS. 9 and 10 illustrate details of the first developing-unit frame 131 and the light-guiding member 141.

As illustrated in FIG. 9, the light-guiding member 141 includes an emission-side light-guiding member 141*a* and a reception-side light-guiding member 141*b*. The emission-side light-guiding member 141*a* guides detecting light 152, emitted from a light-emitting device 150 provided outside the process cartridge 70, into the toner chamber 31*a*. The reception-side light-guiding member 141*b* guides the detecting light 152 transmitted through the toner chamber 31*a* toward a light-receiving device 151. The emission-side light-guiding member 141*a* and the reception-side light-guiding member 141*b* are provided as an integral body formed by injection molding. The emission-side light-guiding member 141*a* includes an entrance 141*c* from which the detecting light 152 emitted from the light-emitting device 150 enters the emission-side light-guiding member 141*a*. The emission-side light-guiding member 141*a* also includes an emission-side window 141*d* (see FIG. 10) from which the detecting light 152 having entered the emission-side light-guiding member 141*a* emerges into the toner chamber 31*a*. In general, a light-emitting device tends to emit diffused light. Hence, the entrance 141*c* has a convex lens shape so as to correct the diffused light into parallel light. The lens shape is designed with considerations for the distance between the light-emitting device 150 and the entrance 141*c* and other factors. Likewise, the reception-side light-guiding member 141*b* includes a reception-side window 141*e* (see FIG. 10) from which the detecting light 152 transmitted through the toner chamber 31*a* enters the reception-side light-guiding member 141*b*. The reception-side light-guiding member 141*b* also includes an exit 141*f* from which the detecting light 152 having entered the reception-side light-guiding member 141*b* emerges toward the light-receiving device 151. As illustrated in FIG. 10, the emission-side window 141*d* and the reception-side window 141*e* face each other, and a spatial optical path 153 along which the detecting light 152 travels is provided therebetween.

The detecting light 152 emerges from the exit 141*f* toward the light-receiving device 151 and is received by the light-receiving device 151, whereby it is detected that the detecting light 152 has been transmitted through the toner chamber 31*a*. In this method of detecting the amount of toner remaining in the toner chamber 31*a*, the remaining amount of toner is estimated by measuring how long the detecting light 152 traveling along the spatial optical path 153 is blocked by the toner 300 during one cycle of stirring of the toner 300 in the toner chamber 31*a* by the toner conveying member 36.

While the first embodiment concerns a case where the remaining amount of toner is detected by the light-guiding member 141 that transmits light, the remaining amount of toner may alternatively be detected by a transmitting member that transmits signals such as radio waves. In the first embodiment, the detecting light 152 may be any of infrared light, far-red light, and the like, as well as visible light.

5. Toner Conveyance Using Light-Guiding Members

A mechanism of conveying toner in the developing unit 4 of the process cartridge 70 according to the first embodiment will now be described.

In the first embodiment, the terms concerning the directions, such as the upper side, the lower side, the vertical direction, and the horizontal direction, used in describing the configurations and operations of the developing unit 4 and the process cartridge 70 refer to the directions in a state where the developing unit 4 and the process cartridge 70 are in proper orientations for use, unless otherwise specified. The proper orientations for use of the developing unit 4 and the process cartridge 70 are established in a state where the developing unit 4 and the process cartridge 70 are properly attached to the body of the image forming apparatus 100 that is properly placed in such a manner as to be ready to perform the image forming operation.

FIGS. 4 and 5 are schematic sectional views of the process cartridge 70 and illustrate how the toner 300 is conveyed.

As illustrated in FIG. 4, the developing unit 4 includes the development chamber 31*b* and the toner chamber 31*a*. The development chamber 31*b* houses the developing roller 25, the toner supplying roller 34, the toner blade 35, and so forth. The toner chamber 31*a* stores the toner 300 to be supplied to the development chamber 31*b* and houses the toner conveying member 36 with which the toner 300 is supplied to the development chamber 31*b*. The toner chamber 31*a* is provided below the development chamber 31*b* in the vertical direction. Hence, the toner 300 needs to be conveyed from the toner chamber 31*a* to the development chamber 31*b* against the gravitational force. An opening 31*c* allowing the toner 300 to pass therethrough is provided between the development chamber 31*b* and the toner chamber 31*a*. The opening 31*c* is provided at the top of the toner chamber 31*a*.

In the first embodiment, in the state where the developing unit 4 (developing device) is set in the body of the image forming apparatus 100, the above elements are positioned in the following order from the lower side in the vertical direction in FIG. 4: the rotating shaft (stirring shaft 36*a*) of the toner conveying member 36, the light-guiding member 141, the lower end of the toner supplying roller 34, the lower end of the developing roller 25, and the lower end of the opening 31*c* at the entrance of the development chamber 31*b*. The lower end of the opening 31*c* at the entrance of the development chamber 31*b* may be positioned between the lower end of the developing roller 25 and the lower end of the toner supplying roller 34 (see FIG. 3).

As illustrated in FIG. 4, the portion 140 of the remaining-amount-detecting device that detects the amount of toner 300 is provided on the sidewall of the toner chamber 31*a*. Furthermore, the toner conveying member 36 that has elasticity and supplies the toner 300 to the development chamber 31*b* is rotatably provided in the toner chamber 31*a*.

The toner conveying member 36 includes the stirring shaft 36*a* and the sheet member 36*b*. The stirring shaft 36*a* includes the rotating shaft that is rotatable by receiving the driving force supplied from the outside. The sheet member 36*b* is attached to the stirring shaft 36*a* and is rotatable together with the stirring shaft 36*a*.

The sheet member 36*b* can be suitably made of, for example, flexible resin sheet such as polyester film, polyphenylene sulfide film, or polycarbonate film. The sheet member 36*b* can have a thickness of 50 μm to 250 μm.

As illustrated in FIG. 4, to convey the toner 300 from the toner chamber 31*a* to the development chamber 31*b*, the sheet member 36*b* is brought into contact with the emission-side window 141*d* and the reception-side window 141*e* (see FIG. 8), which correspond to projecting portions, included in the light-guiding member 141 provided for detection of the remaining amount of toner, whereby the sheet member 36*b* is deformed. In such a configuration, as the toner conveying member 36 rotates, the sheet member 36*b* comes into contact with the emission-side window 141*d* and the reception-side window 141*e*, whereby the sheet member 36*b* receives a stress from the two windows 141*d* and 141*e* and undergoes elastic deformation. Subsequently, after the sheet member 36*b* goes over the two windows 141*d* and 141*e* corresponding to projecting portions, the sheet member 36*b* exerts a restoring force so as to restore its original form, and thus conveys the toner 300 to the development chamber 31*b*.

As described above, the two windows 141*d* and 141*e* as projecting portions included in the light-guiding member 141 as a transmitting member cause the sheet member 36*b* as a part of a conveying member to undergo elastic deformation, whereby the toner 300 as developer is conveyed with the restoring force exerted by the sheet member 36*b*.

That is, the transmitting member has a function as a transmitting member that transmits a signal for detection of the amount of developer and a function of increasing the force with which the conveying member conveys the developer. In the known art, the developer may fall at the projecting portions of the transmitting member. In the first embodiment, since the projecting portions have an additional function of conveying the developer, the falling of the developer that may occur while the developer is being conveyed is reduced.

Figure 1:
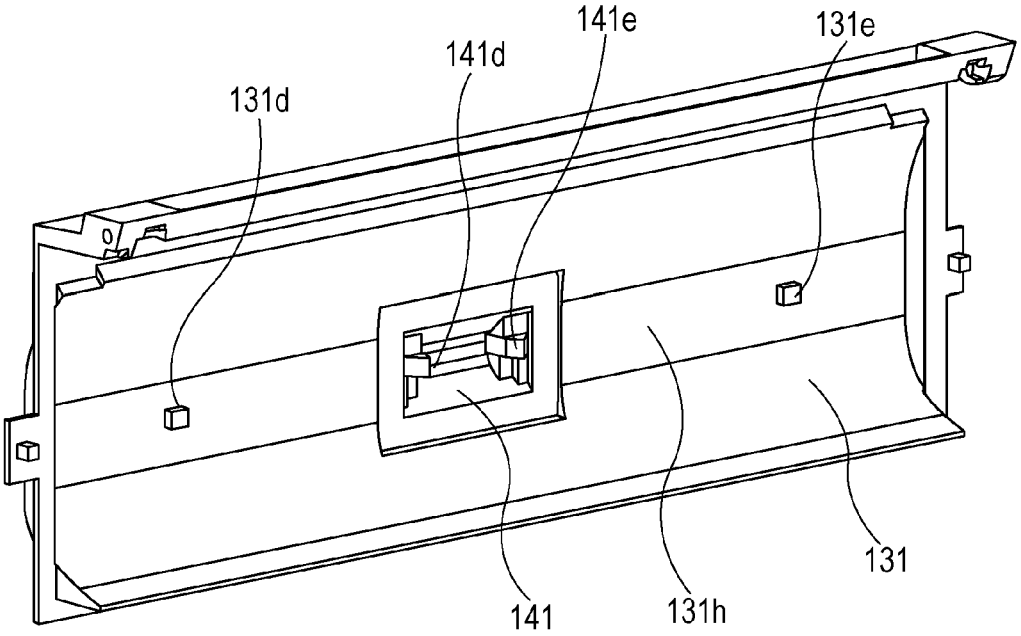
FIG. 1 is a perspective view illustrating details of a mechanism of toner conveyance according to a first embodiment.

For the purpose of further size reduction of the cartridge, it has been attempted to add the function produced at the boundary between the deformation position and the restoration position of the sheet member to the light-guiding member functioning as a transmitting member. In a configuration in which the light-guiding member is provided only in an area at the longitudinal center of the toner chamber (see FIG. 8), the phenomenon that the sheet member is deformed by a portion of the light-guiding member and then restores its original form is more pronounced in the area around the longitudinal center of the toner chamber. In contrast, in areas at the two longitudinal ends of the toner chamber, since the amount of deformation and restoration of the sheet member is smaller than that in the area at the longitudinal center of the toner chamber, the capacity of conveying the developer is therefore smaller than that in the area at the longitudinal center of the toner chamber. Accordingly, the developer to be conveyed to the development chamber may be distributed unevenly, with a larger amount in the longitudinal center but a smaller amount at each of the two longitudinal ends. Consequently, the distribution of developer in the development chamber may become uneven in the longitudinal direction. To avoid such a situation, other projecting portions (first projecting portions) have been employed, in addition to the above projecting portions (second projecting portions) included in the light-guiding member. Herein, the first projecting portions are those each projecting from the inner sidewall of the toner chamber toward the rotating shaft (the conveying-member shaft) when seen in the longitudinal direction of the toner chamber. The second projecting portions as portions of the light-guiding member each also project from the inner sidewall of the toner chamber toward the rotating shaft (the conveying-member shaft) when seen in the longitudinal direction of the toner chamber. In the first embodiment, the first projecting portions and the second projecting portions coincide with each other when seen in the longitudinal direction (in a plane perpendicular to the longitudinal direction). In the first embodiment, two first projecting portions and two second projecting portions are provided. Alternatively, only one first projecting portion and one second projecting portion, or three or more first projecting portions and three or more second projecting portions may be provided. In the first embodiment, as illustrated in FIG. 1, protrusions 131*d* and 131*e* having the same shape as the emission-side window 141*d* and the reception-side window 141*e* of the light-guiding member 141 are additionally provided near two respective longitudinal ends of the first developing-unit frame 131. More specifically, referring to FIG. 5, the protrusions 131*d* and 131*e* each have the same shape as a convex portion 141*t* of each of the windows 141*d* and 141*e* of the light-guiding member 141 that projects beyond the sidewall of the developing-unit frame 31. In such a configuration, the restoring force generated by the deformation and restoration of the sheet member 36*b* is also generated at the two longitudinal ends of the toner chamber 31*a*. Accordingly, the toner 300 is conveyed to the development chamber 31*b* evenly in the longitudinal direction of the development chamber 31*b*. In the first embodiment, the sheet member 36*b* of the toner conveying member 36 simultaneously comes into contact with the first projecting portions and the second projecting portions and undergoes elastic deformation. However, the present invention is not limited to such a configuration. For example, the sheet member may undergo elastic deformation by coming into contact with one of the group of first projecting portions and the group of second projecting portions while being in contact with the other by which the sheet member has already been elastically deformed. The first projecting portions and the second projecting portions are arranged side by side in the longitudinal direction of the toner chamber 31*a*. In FIG. 1, the first projecting portions and the second projecting portions are arranged in a single line extending in the longitudinal direction of the toner chamber 31*a*. Alternatively, the first projecting portions and the second projecting portions may be staggered with respect to each other in the vertical direction. For example, while FIG. 1 illustrates a case where the first projecting portions (the protrusions 131*d* and 131*e*) are provided at the center of a flat surface 131*h*, the first projecting portions (the protrusions 131*d* and 131*e*) may alternatively be provided at the lower end or the upper end of the flat surface 131*h*. In either case, the sheet member needs to be able to undergo a satisfactory level of elastic deformation and to have a satisfactory level of restoring force for restoration after the elastic deformation.

Figure 11:
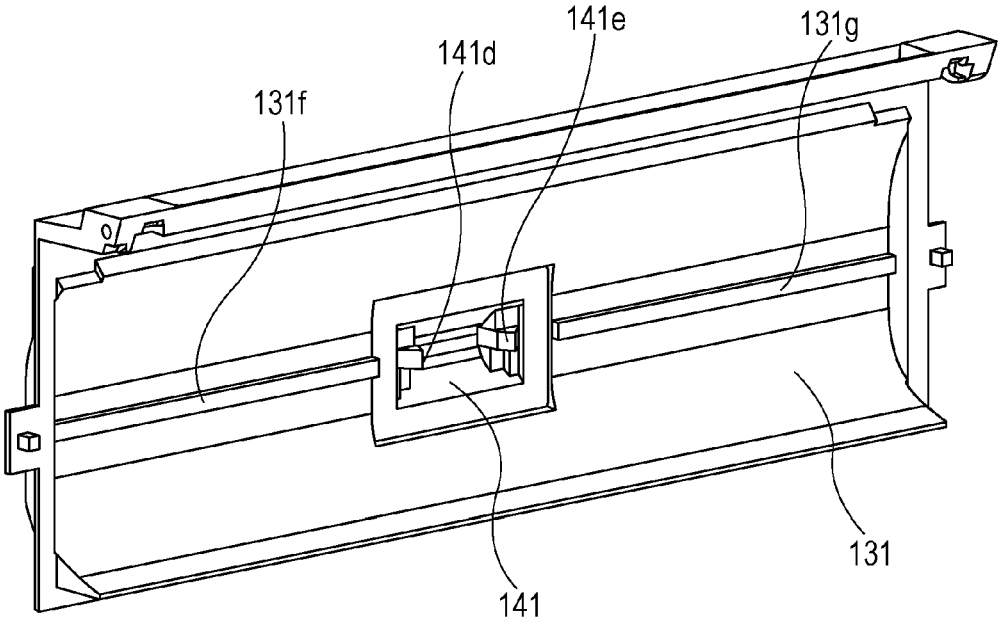
FIG. 11 illustrates projecting portions (first projecting portions) according to a modification of the first embodiment.

As a modification of the first embodiment, referring to FIG. 11, projecting portions 131*f* and 131*g* in the form of ribs extending in the longitudinal direction of the toner chamber 31*a* may be provided. In FIG. 11, the projecting portions 131*f* and 131*g* having the same sectional shape as the emission-side window 141*d* and the reception-side window 141*e* of the light-guiding member 141 are provided in respective areas of the first developing-unit frame 131 where the light-guiding member 141 is absent.

Depending on the configuration of the developing device, the projecting portions as the emission-side window 141*d* and the reception-side window 141*e* of the light-guiding member 141 may be provided at the two respective longitudinal ends, not at the longitudinal center, and other projecting portions separate from the projecting portions included in the light-guiding member 141 may be provided at the longitudinal center. For example, light-guiding members may be provided at the two respective longitudinal ends of the toner chamber, and other projecting portions may be provided at the longitudinal center of the toner chamber.

Second Embodiment

Process Cartridge

An overall configuration of a process cartridge 70 according to a second embodiment of the present invention that is attached to the image forming apparatus 100 will now be described.

Figure 12:
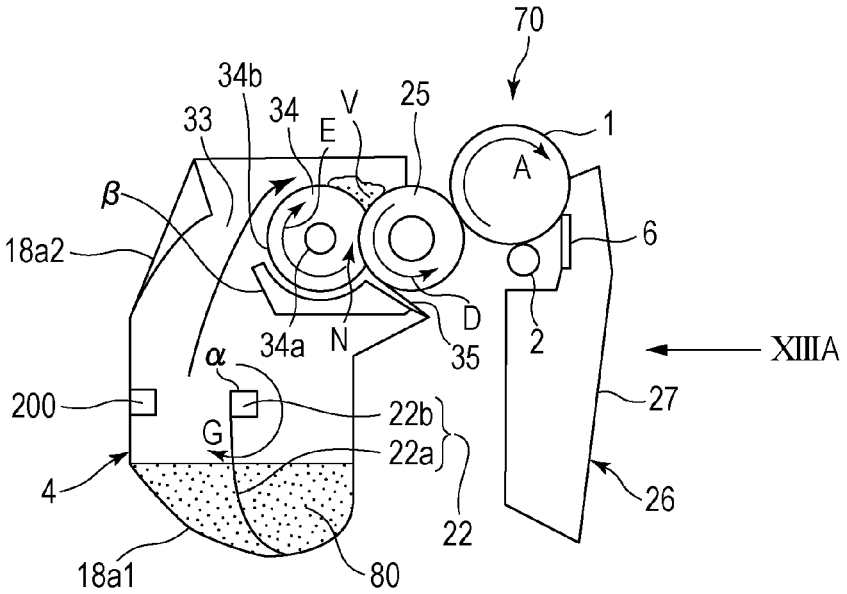
FIG. 12 is a schematic sectional view of a developing device according to a second embodiment.

FIG. 12 is a schematic sectional view (illustrating a major section) of one of process cartridges 70 according to the second embodiment that is seen in the longitudinal direction (the direction of the axis of rotation) of the photosensitive drum 1. In the second embodiment, all of the process cartridges 70 provided for the different colors have substantially the same configuration, except the kinds (colors) of the developers to be used, and operate substantially in the same manner. Each process cartridge 70 is a unit in which a photosensitive-drum unit 26 including the photosensitive drum 1 and so forth and the developing unit 4 including the developing roller 25 and so forth are combined together.

The photosensitive-drum unit 26 includes a cleaning-member frame 27 that supports elements provided in the photosensitive-drum unit 26. The photosensitive drum 1 is rotatably attached to the cleaning-member frame 27 with a bearing (not illustrated) interposed therebetween. When a driving force generated by a driving motor (a drive source, not illustrated) as a driving device is transmitted to the photosensitive-drum unit 26, the photosensitive drum 1 rotates in a direction of arrow A (the clockwise direction) illustrated in FIG. 12 in accordance with the image forming operation. In the second embodiment, the photosensitive drum 1 as a major element in the image forming process is an organic photosensitive drum that includes an aluminum cylinder whose outer circumferential surface is coated with functional films that are provided in order of an undercoat layer, a carrier generating layer, and a carrier transporting layer.

In the photosensitive-drum unit 26, the cleaning member 6 and the charging roller 2 are provided in contact with the circumferential surface of the photosensitive drum 1. Toner remaining on the surface of the photosensitive drum 1 after the transfer is removed and is dropped into the cleaning-member frame 27 by the cleaning member 6 and is stored in the cleaning-member frame 27.

In this state, the charging roller 2 as a charging device including a roller member made of conductive rubber is pressed against the photosensitive drum 1, thereby rotating with the rotation of the photosensitive drum 1.

The charging roller 2 includes a core bar, via which a predetermined direct-current (DC) voltage is applied to the photosensitive drum 1 in a charging step. Thus, the photosensitive drum 1 has a dark-portion potential (Vd) evenly over the surface thereof. Then, the surface of the photosensitive drum 1 is exposed to a pattern of laser light emitted from the scanner unit 3 in accordance with image data. In the exposed portions of the surface of the photosensitive drum 1, the charge is eliminated by carriers generated in the carrier generating layer, whereby the potential is reduced. Consequently, the exposed portions have a predetermined light-portion potential (Vl) while the unexposed portions have a predetermined dark-portion potential (Vd), whereby an electrostatic latent image is formed on the photosensitive drum 1. In the second embodiment, Vd is −520 V, and Vl is −100 V.

The developing unit 4 includes a development chamber that houses the developing roller 25 as a developer bearing member that carries developer (toner) 80 and the toner supplying roller 34 as a developer supplying member that supplies the toner 80 to the developing roller 25. The developing unit 4 further includes a developer storing chamber, specifically, a toner chamber 18, in which the toner 80 is stored. The toner chamber 18 is provided below the toner supplying roller 34 in the gravitational direction and communicates with the development chamber via an opening 33.

The toner supplying roller 34 rotates while being in contact with the developing roller 25, whereby a nip N is formed therebetween.

The toner chamber 18 houses a toner conveying member 22. The toner conveying member 22 stirs the toner 80 in the toner chamber 18 and conveys the toner 80 in a direction of arrow G illustrated in FIG. 12 toward an area V at the top of the toner supplying roller 34.

The toner blade 35 is provided below the developing roller 25 and is in contact with the developing roller 25 in such a manner as to rotate in a forward direction with respect to the rotation of the developing roller 25. The toner blade 35 regulates the amount of toner 80 supplied from the toner supplying roller 34 and coating the developing roller 25, and supplies an electrical charge to the toner 80 and to the developing roller 25. In the second embodiment, the toner blade 35 is a leaf-spring-like thin plate made of stainless steel and having a thickness of 0.1 mm. The elastic force of the thin plate is utilized in generating a contact pressure. The surface of the thin plate is brought into contact with the toner 80 and the developing roller 25.

The toner blade 35 is not limited to that described above and may be a metal thin plate made of phosphor bronze, aluminum, or the like. Moreover, the surface of the toner blade 35 may be coated with a thin film made of a polyamide elastomer, urethane rubber, urethane resin, or the like.

The toner 80 is triboelectrically charged by the friction between the toner blade 35 and the developing roller 25, thereby having an electrical charge. Simultaneously, the thickness of a layer of toner 80 on the developing roller 25 is regulated by the toner blade 35. In the second embodiment, a blade-bias power supply (not illustrated) applies a predetermined voltage to the toner blade 35, whereby the formation of the toner coat is stabilized. In the second embodiment, a blade bias V of −500 V is applied to the toner blade 35. The developing roller 25 and the photosensitive drum 1 rotate such that the respective surfaces thereof move in the same direction (in the second embodiment, a direction from the lower side toward the upper side) in the area where the developing roller 25 and the photosensitive drum 1 are in contact with each other (the contact area).

In the second embodiment, the developing roller 25 is provided in contact with the photosensitive drum 1. Alternatively, the developing roller 25 may be provided in proximity to the photosensitive drum 1 with a predetermined gap interposed therebetween.

In the second embodiment, the toner 80 is negatively triboelectrically charged with the predetermined DC bias applied to the developing roller 25. In the development area where the developing roller 25 is in contact with the photosensitive drum 1, the charged toner 80 is transferred only to portions of the photosensitive drum 1 that have the light-portion potential. The transfer occurs because of the potential difference between the toner 80 and the photosensitive drum 1. Thus, the electrostatic latent image is visualized. In the second embodiment, a potential difference ΔV with respect to the portions having the light-portion potential is set to 200 V by applying a bias of −300 V to the developing roller 25, whereby a toner image is formed.

The toner supplying roller 34 faces the developing roller 25 and is in contact with the circumferential surface of the developing roller 25, whereby a predetermined contact part (nip) N is provided. The toner supplying roller 34 rotates in a direction of arrow E (clockwise) illustrated in FIG. 12. The toner supplying roller 34 is an elastic sponge roller including a conductive core bar and a foam layer provided therearound. The toner supplying roller 34 and the developing roller 25 are in contact with each other by a predetermined amount of biting such that the toner supplying roller 34 is depressed by the developing roller 25, as illustrated in FIG. 12, by an amount of depression ΔE. In the nip N, the toner supplying roller 34 and the developing roller 25 rotate in the same direction but at different circumferential speeds. With such rotations of the toner supplying roller 34 and the developing roller 25, the toner supplying roller 34 supplies the toner 80 to the developing roller 25. In this operation, the amount of toner to be supplied to the developing roller 25 is adjustable by adjusting the potential difference between the toner supplying roller 34 and the developing roller 25. In the second embodiment, the toner supplying roller 34 rotates at 200 rpm, the developing roller 25 rotates at 100 rpm, and DC biases are applied to the toner supplying roller 34 and the developing roller 25, respectively, such that the potential V of the developing roller 25 is −100 V with respect to the potential of the toner supplying roller 34.

In the second embodiment, the developing roller 25 and the toner supplying roller 34 each have an outside diameter of 15 mm. The amount of biting into the toner supplying roller 34 by the developing roller 25, that is, the amount of depression ΔE by which the toner supplying roller 34 is depressed by the developing roller 25, is set to 1.0 mm. The centers of the developing roller 25 and the toner supplying roller 34 are positioned at the same level.

The toner supplying roller 34 according to the second embodiment includes the conductive core bar and the foam layer supported by the conductive core bar. Specifically, the toner supplying roller 34 includes a core bar electrode 34*a* corresponding to the conductive core bar and having an outside diameter of 5 mm, and a urethane foam layer 34*b* corresponding to the foam layer and provided around the core bar electrode 34*a*. The urethane foam layer 34*b* is composed of open-celled foam in which foam cells are continuous with one another. The toner supplying roller 34 rotates in the direction of arrow E as illustrated in FIG. 12.

Since the urethane foam layer 34*b* provided on the outer circumference of the toner supplying roller 34 is made of open-celled foam, a large amount of toner is receivable by the toner supplying roller 34. In the second embodiment, the toner supplying roller 34 has a resistance of $1\times10^{9}\Omega$.

The resistance of the toner supplying roller 34 is measured as follows. The toner supplying roller 34 is brought into contact with an aluminum sleeve having a diameter of 30 mm such that the amount of biting into the toner supplying roller 34 is 1.5 mm. In this state, the aluminum sleeve is rotated, whereby the toner supplying roller 34 is rotated at 30 rpm.

Then, a DC voltage of −50 V is applied to the developing roller 25. In this step, a resistor of 10 kΩ is provided on the grounded side, and the voltage across the two ends of the resistor is measured, whereby the current is calculated, and the resistance of the toner supplying roller 34 is calculated. In the second embodiment, the cell size of the urethane foam layer 34*b* of the toner supplying roller 34 is set to 50 μm to 1000 μm.

Herein, the term "cell size" refers to the average diameter of the cells included in an arbitrary section of the urethane foam layer 34*b*. First, the area of the largest one of the cells is measured by taking an enlarged image of an arbitrary section, and the measured area is converted into the diameter of a perfect circle equivalent to the area, whereby the largest cell diameter is obtained. Cells having the diameters smaller than or equal to ½ of the largest cell diameter are omitted as noise. Then, the diameters of the remaining cells are obtained likewise on the basis of the areas of the respective cells, and the average of the diameters thus obtained is taken as the cell size.

Now, how the toner 80 circulates in the development chamber when the toner supplying roller 34 is rotating in the direction of arrow E will be described.

The toner 80 in the toner chamber 18 is thrown upward by the toner conveying member 22. Most of the toner 80 thus thrown is conveyed to an area above the toner supplying roller 34. The toner 80 thus conveyed to the toner supplying roller 34 stays on the surface of or enters the toner supplying roller 34. As the toner supplying roller 34 rotates in the direction of arrow E as illustrated in FIG. 12, the toner 80 is conveyed to a position immediately before the nip N between the toner supplying roller 34 and the developing roller 25. The toner supplying roller 34 deforms at the position immediately before the nip N. With the deformation, the toner 80 having been on the surface or in the cells of the urethane foam layer 34*b* is ejected. The toner 80 thus ejected accumulates in the area above and between the developing roller 25 and the toner supplying roller 34 (hereinafter the area is referred to as "temporary toner storage V").

With the rotations of the developing roller 25 and the toner supplying roller 34, some of the toner 80 accumulated in the temporary toner storage V enters the nip N. With the friction between the developing roller 25 and the toner supplying roller 34, an electrical charge is supplied to the toner 80 that have entered the nip N. The toner 80 now having the electrical charge passes through the nip N and is electrostatically attracted to the developing roller 25 in accordance with the amount of its electrical charge. Thus, the toner 80 is supplied from the toner supplying roller 34 to the developing roller 25. Some of the toner 80 thus supplied to the developing roller 25 is removed by the toner blade 35, whereby a toner coat having a predetermined thickness is provided on the developing roller 25. The toner 80 thus removed drops under the gravitational force and returns to the toner chamber 18.

As described above, a toner coat is provided by supplying the toner 80 from the temporary toner storage V to the developing roller 25. To form the toner coat stably, a predetermined amount of toner 80 needs to be continuously and stably supplied to the temporary toner storage V.

Toner Conveying Member

The toner conveying member 22 included in the developing unit 4 according to the second embodiment will now be described in detail.

As illustrated in FIG. 12, the toner conveying member 22 includes a flexible sheet portion 22*a* functioning as a conveying portion that conveys the toner 80, and a conveying-member supporting shaft (rotating shaft) 22*b* to which the sheet portion 22*a* is attached and that receives a rotational driving force. The conveying-member supporting shaft 22*b* extends parallel to the photosensitive drum 1, the developing roller 25, and the toner supplying roller 34 and over the entire length of the toner chamber 18 in the longitudinal direction (the direction of axis of rotation). The sheet portion 22*a* is a sheet (a plate-like member) continuously extending substantially over the entire length of the conveying-member supporting shaft 22*b* in the longitudinal direction (the direction of axis of rotation). The sheet portion 22*a* is attached to the conveying-member supporting shaft 22*b* at one end thereof in a direction orthogonal to the longitudinal direction of the conveying-member supporting shaft 22*b* (in the radial direction, or the short-side direction). The toner conveying member 22 is rotatably supported by the toner chamber 18, corresponding to a developing-unit frame, at the two ends in the longitudinal direction (the direction of axis of rotation) thereof. The toner conveying member 22 is driven by a driving device (drive source, not illustrated) and thus rotates in a direction of arrow G (clockwise) as illustrated in FIG. 12.

The sheet portion 22*a* according to the second embodiment is made of polycarbonate (PC) film and has a thickness of 190 μm. The thickness of the sheet portion 22*a* can be set within a range from 50 μm to 250 μm. The sheet portion 22*a* has a free length of 60 mm and is fixed to the conveying-member supporting shaft 22*b* with a margin for fixing of 10 mm. If the length of the margin for fixing can be increased, the amount of bend in the sheet portion 22*a* is increased. For example, the amount of bend may be increased by fixing the sheet portion 22*a* to another face, for example, a face a denoted in FIG. 12, of the conveying-member supporting shaft 22*b*. While the second embodiment concerns a case where the conveying-member supporting shaft 22*b* is a rectangular bar having a square sectional shape, the conveying-member supporting shaft 22*b* is not limited such a bar. The conveying-member supporting shaft 22*b* may be a bar having a polygonal or round sectional shape or a sectional shape defined by curved surfaces and flat surfaces, as long as the sheet portion 22*a* can be fixed thereto and is allowed to rotate.

The combination of the material and the thickness of the sheet portion 22*a* are not limited to that described in the second embodiment. For example, the sheet portion 22*a* may be made of any of polyester film, polyphenylene sulfide film, polycarbonate film, and the like. That is, the sheet portion 22*a* only needs to be deformable.

Projecting Portions

A function of projecting portions 200 included in the developing unit 4 according to the second embodiment will now be described in detail.

Referring to FIG. 12, the toner chamber 18 has the projecting portions 200 on the downstream side with respect to a guide portion 18*a*1 and on the upstream side with respect to the opening 33 in the direction of rotation of the toner conveying member 22. Seen in the longitudinal direction of the toner chamber 18 (in a sectional view taken orthogonally to the longitudinal direction), the projecting portions 200 each project from the inner sidewall of the toner chamber 18 toward the conveying-member supporting shaft 22*b* (conveying-member shaft) of the toner conveying member 22. The projecting portions 200 have a function of temporarily releasing the toner conveying member 22 that has been in contact with the inner wall of the toner chamber 18 from the inner wall of the toner chamber 18.

Figure 13A:
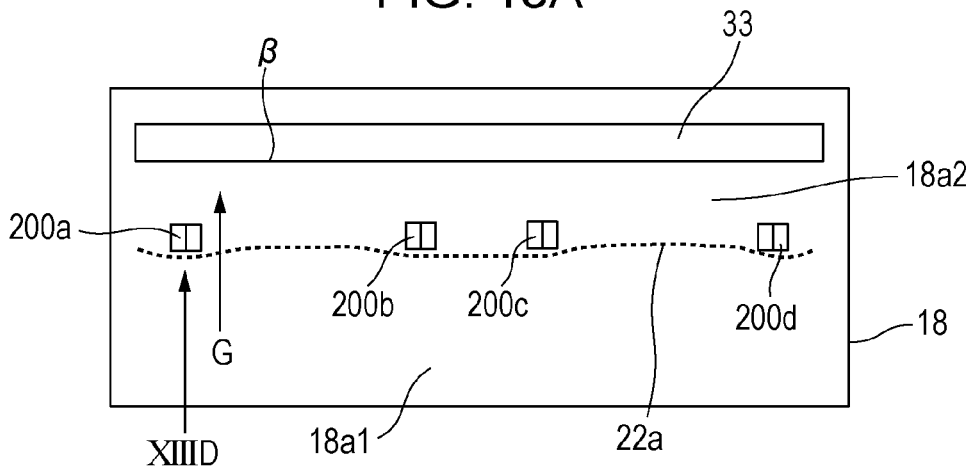
FIGS. 13A to 13D illustrate how a conveying member behaves in the second embodiment.
Figure 13B:
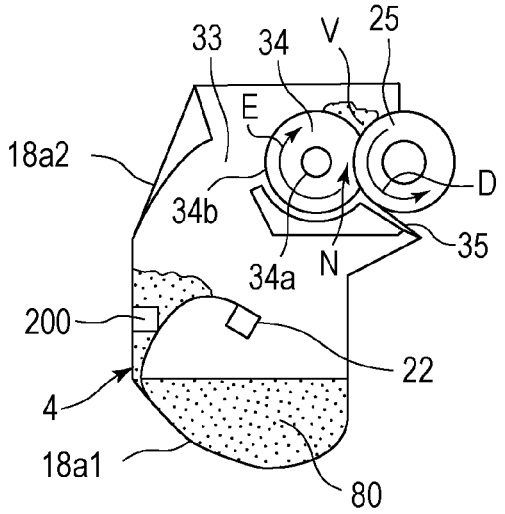
Figure 13C:
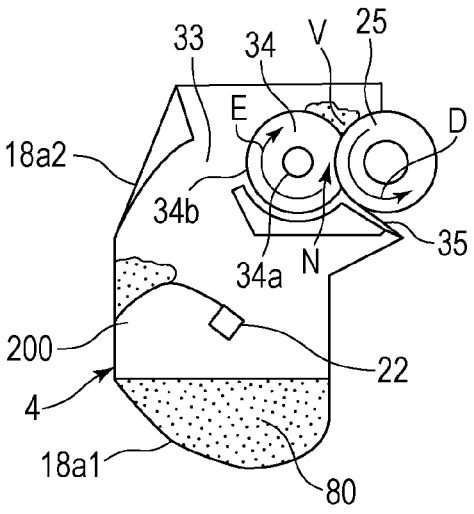
Figure 13D:
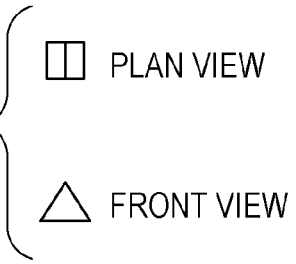

FIG. 13A is a longitudinal sectional view of the developing unit 4 seen in a direction of arrow XIIIA illustrated in FIG. 12. The broken line illustrated in FIG. 13A schematically represents how the sheet portion 22*a* of the toner conveying member 22 is bent in the longitudinal direction thereof by the projecting portions 200. As illustrated in FIG. 13A, the sheet portion 22*a* is bent by the projecting portions 200 in some areas thereof and by the guide portion 18*a*1 in other areas thereof. FIGS. 13B and 13C are schematic sectional views of the developing unit 4 taken at a position where the sheet portion 22*a* is bent by one of the projecting portions 200 and at a position where the sheet portion 22*a* is bent by the guide portion 18*a*1, respectively, in the state illustrated in FIG. 13A. FIG. 13D includes a plan view and a front view of one of the projecting portions 200 according to the second embodiment in a direction of arrow XIIID illustrated in FIG. 13A. The projecting portion 200 illustrated in FIG. 13D has a convex shape with a height of 2 mm, a width of 4 mm, and a depth of 4 mm. As illustrated in FIG. 13A, four projecting portions 200, specifically, a first projecting portion 200*b*, a second projecting portion 200*a*, a third projecting portion 200*c*, and a fourth projecting portion 200*d*, are arranged side by side in the longitudinal direction of the toner conveying member 22 in the toner chamber 18. The order of the projecting portions 200 described herein is only defined as a matter of convenience and is not limited thereto. That is, the order of the first to fourth projecting portions 200 may be reversed. However, in the following description, the projecting portions 200 are denoted as the first projecting portion 200*b*, the second projecting portion 200*a*, the third projecting portion 200*c*, and the fourth projecting portion 200*d*. The second projecting portion 200*a* and the fourth projecting portion 200*d* are each provided on the inner side by 10 mm with respect to a corresponding one of two ends of the opening 33. The first projecting portion 200*b* and the second projecting portion 200*a* are spaced apart from each other by 90 mm, and so are the third projecting portion 200*c* and the fourth projecting portion 200*d*. The sheet portion 22*a* is bent by the guide portion 18*a*1 in a portion between the second projecting portion 200*a* and the first projecting portion 200*b* and in a portion between the third projecting portion 200*c* and the fourth projecting portion 200*d* as illustrated in FIG. 13C. The sheet portion 22*a* is bent by each of the first projecting portion 200*b*, the second projecting portion 200*a*, the third projecting portion 200*c*, and the fourth projecting portion 200*d* as illustrated in FIG. 13B. The amount of bending by each of the projecting portions 200 is larger than that by the guide portion 18*a*1 illustrated in FIG. 13C. The projecting portions 200 are made of polystyrene (PS) as with the toner chamber 18.

In the second embodiment, the projecting portions 200 are arranged in a horizontal plane containing the conveying-member supporting shaft 22*b* of the toner conveying member 22, and the amount of bend in the sheet portion 22*a* of the toner conveying member 22 is largest at each of the projecting portions 200. The vector representing the initial velocity at which the sheet portion 22*a* of the toner conveying member 22 that has been bent is released is oriented upward in the gravitational direction (in a direction at 180° with respect to the direction in which the gravitational force acts). That is, in the second embodiment, the magnitude of the velocity vector oriented upward in the gravitational direction becomes largest during a period from when the free end of the sheet portion 22*a* of the toner conveying member 22 that has been bent is released until the free end of the sheet portion 22*a* of the toner conveying member 22 comes into contact with the toner chamber 18. The projecting portions 200 are provided so as to establish such a situation.

More specifically, the projecting portions 200 are provided for bending the sheet portion 22*a* of the toner conveying member 22 such that, during one revolution of the sheet portion 22*a*, the velocity vector at the free end of the sheet portion 22*a* is oriented upward in the gravitational direction with largest magnitude after the free end of the sheet portion 22*a* that has been bent is released. More specifically, when the velocity vector at the free end of the sheet portion 22*a* of the toner conveying member 22 is decomposed into a velocity vector in the gravitational direction and a velocity vector in the horizontal direction, the magnitude of the velocity vector oriented upward in the gravitational direction only needs to become largest at the above timing. That is, the resultant velocity vector at the free end of the sheet portion 22*a* of the toner conveying member 22 that has been released may be oriented obliquely upward.

In such a configuration, the repulsive force of the sheet portion 22*a* of the toner conveying member 22 is fully utilized, and the amount of toner 80 scoopable is maximized.

Figure 26A:
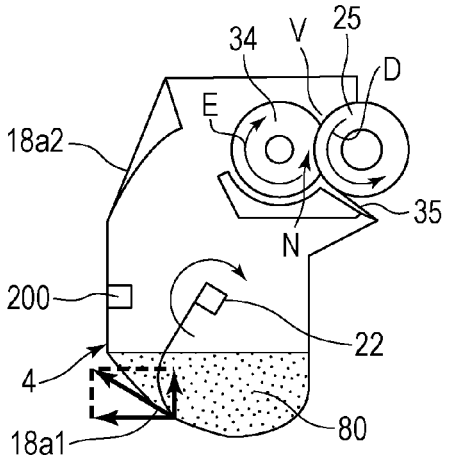
FIGS. 26A to 26D illustrate velocity vectors.

Now, the relationship between the velocity vector and the free end of the sheet portion 22*a* of the toner conveying member 22 will be described more specifically with reference to FIGS. 26A to 26D. As illustrated in FIG. 26A, the free end of the sheet portion 22*a* of the toner conveying member 22 is in contact with the bottom of the toner chamber 18. Therefore, while the toner conveying member 22 is rotated with a driving force supplied thereto from an external device, the velocity vector at the free end of the sheet portion 22*a* of the toner conveying member 22 is suppressed to be small because of the frictional resistance with respect to the surface of the toner chamber 18 and the presence of a certain amount of toner 80. Even if the velocity vector produced in the state illustrated in FIG. 26A is decomposed into a velocity vector in the gravitational direction and a velocity vector in the horizontal direction, the velocity vector oriented upward in the gravitational direction does not have a very large magnitude.

Figure 26B:
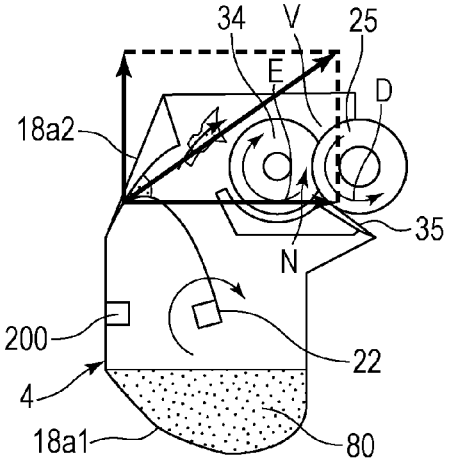
Figure 26C:
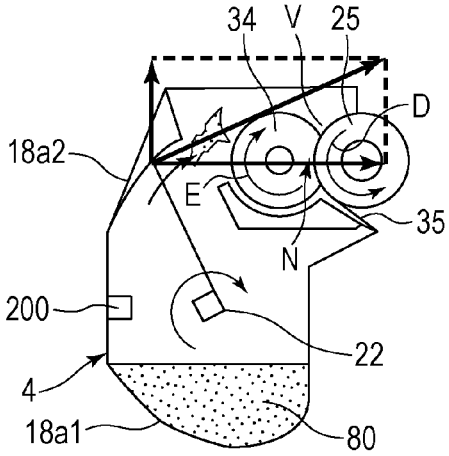

After the state illustrated in FIG. 26A, the sheet portion 22*a* of the toner conveying member 22 comes into contact with the projecting portions 200. When the sheet portion 22*a* comes into contact with the projecting portions 200, the sheet portion 22*a* is first bent. Thereafter, the sheet portion 22*a* goes out of contact with the projecting portions 200, that is, the sheet portion 22*a* that has been bent is released. The moment that the sheet portion 22*a* having been bent is released, the velocity vector at the free end of the sheet portion 22*a* that is oriented upward in the gravitational direction becomes largest. The free end of the sheet portion 22*a* that has been released from the projecting portions 200 undergoes a rotational motion and conveys the toner 80 into the development chamber. Thus, the moment that the sheet portion 22*a* is released from the projecting portions 200, the velocity vector at the free end of the sheet portion 22*a* that is oriented upward in the gravitational direction becomes largest relative to the resultant velocity vector. Thereafter, since the sheet portion 22*a* undergoes a rotational motion, the resultant velocity vector at the free end of the sheet portion 22*a* inclines from the gravitational direction and is oriented closer to the horizontal direction. As illustrated in FIGS. 26B and 26C, the magnitude of the resultant velocity vector does not change greatly. However, when the resultant velocity is decomposed into a velocity vector in the gravitational direction and a velocity vector in the horizontal directions, the magnitude of the velocity vector oriented upward in the gravitational direction is reduced gradually.

Figure 26D:
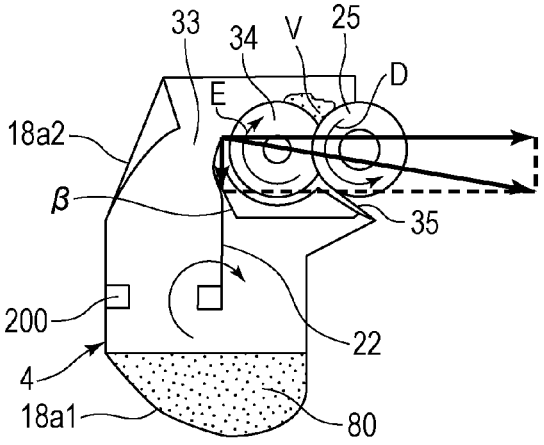

Subsequently, the sheet portion 22*a* of the toner conveying member 22 collides with the lower end of the opening 33. At the collision, the tip of the sheet portion 22*a* rotates about the point of collision. Therefore, the magnitude of the resultant velocity vector at the free end of the sheet portion 22*a* temporarily increases (as illustrated in FIG. 26D). However, when the resultant velocity vector is decomposed into a velocity vector in the gravitational direction and a velocity vector in the horizontal direction, the velocity vector in the horizontal direction dominates most part of the resultant velocity vector. Thus, the toner 80 is efficiently used up while being conveyed with the repulsive force exerted when the sheet portion 22*a* is released from the projecting portions 200.

In contrast, if too many projecting portions 200 are provided, the amount of toner 80 that can be held by the sheet portion 22*a* of the toner conveying member 22 is reduced in correspondence with the volumes of the projecting portions 200. In the second embodiment, trade-off items with respect to the amount of bend in the sheet portion 22*a* and the amount of toner 80 holdable by the sheet portion 22*a* are optimized through verifications of examples given separately below. The trade-off items include the material of the sheet portion 22*a*; the number of revolutions, the running torque, and the like of the toner conveying member 22; and the height, the number, and the pitch of projecting portions 200.

Hence, according to the second embodiment, to optimize the amount of bend in the sheet portion 22*a* and the amount of toner 80 holdable by the sheet portion 22*a*, areas of the sheet portion 22*a* that are bent by the projecting portions 200 and areas of the sheet portion 22*a* that are bent by the inner wall of the toner chamber 18 both need to be present in the longitudinal direction of the sheet portion 22*a*.

Furthermore, according to the second embodiment, if the volumes of the projecting portions 200 are optimized, the toner 80 can be stored efficiently in the toner chamber 18 without reducing the capacity of the toner chamber 18.

While the second embodiment concerns a case where the projecting portions 200 each having the shape illustrated in the associated drawings, the present invention is not limited to such a case. The projecting portions 200 may be in any of surface contact, line contact, and point contact with the sheet portion 22*a* of the toner conveying member 22. Moreover, the projecting portions 200 may each have a curved surface at the tip thereof or may each have a polygonal shape, a round shape, or a shape obtained by a combination of curved surfaces and flat surfaces, as long as the sheet portion 22*a* of the toner conveying member 22 can be bent by a desired amount. While the second embodiment concerns a case where the projecting portions 200 all have the same shape, the present invention is not limited to such a case. The projecting portions 200 may have respectively different shapes.

Guide Portion

As illustrated in FIGS. 14A to 14D, the toner chamber 18 has the guide portion 18*a*1 extending at the bottom of the toner chamber 18 and functioning as a deforming portion that comes into contact with the sheet portion 22*a* of the toner conveying member 22, and a guide portion 18*a*2 extending from the projecting portions 200 up to the opening 33.

Figure 14A:
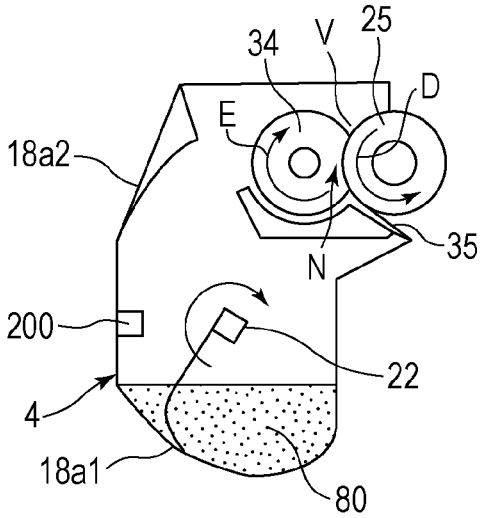
FIGS. 14A to 14D illustrate how the conveying member behaves in the second embodiment.

FIG. 14A is a sectional view of the developing unit 4 and schematically illustrates how the sheet portion 22*a* of the toner conveying member 22 is bent when moving along the guide portion 18*a*1. The guide portion 18*a*1 is a curved portion of the inner wall of the toner chamber 18 and extends up to the projecting portions 200 where the sheet portion 22*a* of the toner conveying member 22 is released. When the toner conveying member 22 rotates, the sheet portion 22*a* of the toner conveying member 22 comes into contact with the guide portion 18*a*1, whereby the sheet portion 22*a* receives a force from the guide portion 18*a*1. Consequently, the sheet portion 22*a* deforms against the elastic force thereof. In this state, the toner conveying member 22 rotates while the sheet portion 22*a* thereof is in contact with the guide portion 18*a*2, whereby the toner conveying member 22 conveys the toner 80 that is held on the downstream side of the sheet portion 22*a* in the direction of rotation thereof.

Figure 14B:
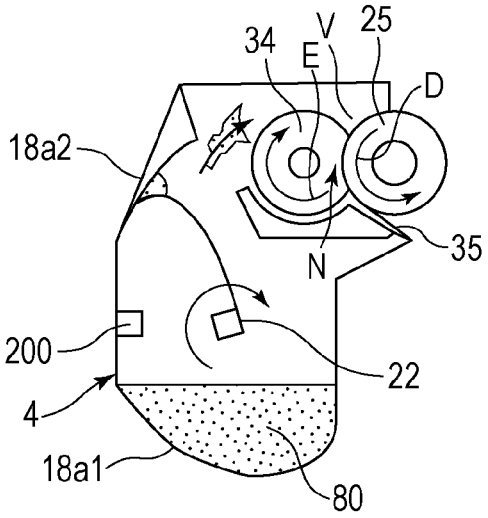

FIG. 14B is a sectional view of the developing unit 4 and schematically illustrates how the sheet portion 22*a* of the toner conveying member 22 is bent when moving along the guide portion 18*a*2.

The guide portion 18*a*2 is a portion of the inner wall of the toner chamber 18 that extends between the projecting portions 200 and the opening 33. The guide portion 18*a*2 starts from a position below the lower end (the lowest point) of the opening 33. Hence, the moment that the sheet portion 22*a* of the toner conveying member 22 goes out of contact with the projecting portions 200, the sheet portion 22*a* comes into contact, with the elastic force thereof, with a portion β of the toner chamber 18 that is on the lower side of the opening 33 after being rubbed against the surface of the guide portion 18*a*2. Since the guide portion 18*a*2 extends along a locus defined by the radius of rotation of the sheet portion 22*a* of the toner conveying member 22, the sheet portion 22*a* does not receive a bending pressure from the guide portion 18*a*2. Thus, the toner conveying member 22 can rotate while the sheet portion 22*a* is rubbed against the guide portion 18*a*2 but does not receive a bending pressure. That is, the free end of the sheet portion 22*a* is in contact with the guide portion 18*a*2, i.e., a portion of the inner wall of the toner chamber 18, at a position on the downstream side with respect to the projecting portions 200 and on the upstream side with respect to the opening 33 in the direction of rotation of the toner conveying member 22. More specifically, the sheet portion 22*a* can be in contact with the inner wall of the toner chamber 18 during a period from when the sheet portion 22*a* that has been bent restores its original form until when the sheet portion 22*a* reaches the edge of the opening 33. Even if the sheet portion 22*a* does not reach the edge of the opening 33, the sheet portion 22*a* only needs to reach a position immediately before the edge of the opening 33. Moreover, after the sheet portion 22*a* is released from the projecting portions 200, the sheet portion 22*a* may be temporarily out of contact with the inner wall of the toner chamber 18. Nevertheless, the sheet portion 22*a* can be designed so as to be continuously in contact with at least portions of the inner wall that are between the projecting portions 200.

If the radius of curvature of the guide portion 18*a*2 is too much shorter than the radius of rotation of the sheet portion 22*a*, the sheet portion 22*a* is bent by the guide portion 18*a*2 again. Consequently, the rotation of the toner conveying member 22 after the sheet portion 22*a* has gone over the projecting portions 200 may be suddenly stopped, affecting the flying of the toner 80. That is, if the rotation of the toner conveying member 22 is suddenly stopped after the sheet portion 22*a* that has been bent is released, the impact of the stopping may change the direction in which the toner 80 flies. Furthermore, the toner 80 that has been held by the sheet portion 22*a* may fall into the toner chamber 18 with the impact. Consequently, the amount of toner 80 supplied to the toner chamber 18 may be reduced.

To provide a configuration in which the sheet portion 22*a* of the toner conveying member 22 comes into contact with the guide portion 18*a*2 forming a portion of the inner wall of the toner chamber 18, the radius of rotation of the sheet portion 22*a* needs to be set longer than a distance (a first distance) from the conveying-member supporting shaft 22*b* to a portion of the inner wall of the toner chamber 18 with which the free end of the sheet portion 22*a* comes into contact. More specifically, the positional relationship among the conveying-member supporting shaft 22*b* of the toner conveying member 22, the free end of the sheet portion 22*a* of the toner conveying member 22, and the inner wall of the toner chamber 18 can be expressed as 0.0 mm<(radius of rotation−first distance)<2.5 mm.

As described above, since the sheet portion 22*a* of the toner conveying member 22 are in contact with the guide portion 18*a*2, the toner 80 can be held between the sheet portion 22*a* of the toner conveying member 22 and the inner wall of the toner chamber 18 even if the sheet portion 22*a* has creep (deformation) as illustrated in FIG. 14B. Hence, the toner 80 can be conveyed directly into the opening 33.

Figure 14C:
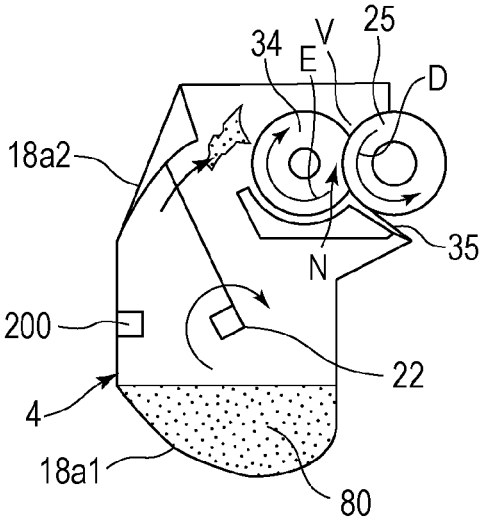
Figure 14D:
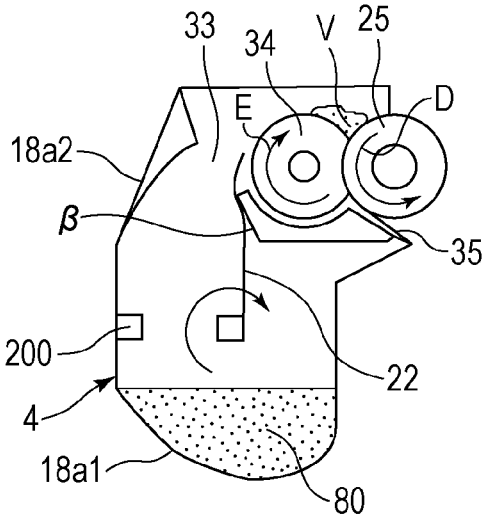

FIG. 14D is a sectional view of the developing unit 4 and illustrates how the sheet portion 22*a* of the toner conveying member 22 is bent when coming into contact with the portion β of the toner chamber 18 that is on the lower side of the opening 33. The toner 80 remaining on the sheet portion 22*a* is assuredly thrown into the development chamber, regardless of whether the sheet portion 22*a* is deformed or not.

In the second embodiment, to assuredly cause the sheet portion 22*a* of the toner conveying member 22 to be rubbed against the guide portion 18*a*2, the length of the guide portion 18*a*2 is set to 35 mm, which is substantially the same as the free length of the sheet portion 22*a* of 34 mm.

Toner Conveying Operation

The operation of conveying the toner 80 in the toner chamber 18 according to the second embodiment will further be described chronologically on the basis of the above description.

(1) The toner conveying member 22 is driven and is thus rotated in the direction of arrow G (see FIG. 12).

(2) With the rotation of the toner conveying member 22, the sheet portion 22*a* of the toner conveying member 22 moves along the guide portion 18*a*1, thereby receiving a force from the guide portion 18*a*1. Consequently, the sheet portion 22*a* deforms against the elastic force thereof (see FIG. 14A).

(3) The sheet portion 22*a*, holding some toner 80 in areas thereof that are deformed by the guide portion 18*a*1, reaches the projecting portions 200 (see FIG. 13B).

(4) In the state where the sheet portion 22*a* has reached the projecting portions 200, areas of the sheet portion 22*a* that are bent by the projecting portions 200 and areas of the sheet portion 22*a* that are bent by the guide portion 18*a*1 are both present in the longitudinal direction of the toner chamber 18. (see FIG. 13A).

(5) As the toner conveying member 22 is further rotated and the sheet portion 22*a* goes over the projecting portions 200, the sheet portion 22*a* that has been bent is released, whereby the toner 80 held by the sheet portion 22*a* is thrown up with an elastic energy exerted by the releasing of the sheet portion 22*a* (see FIG. 14C).

(6) Most of the toner 80 flies along the inner wall of the toner chamber 18, passes through the opening 33, and is supplied into the temporary toner storage V.

(7) After the sheet portion 22*a* is released, following the flying of the toner 80, the tip of the free end of the sheet portion 22*a* moves along the guide portion 18*a*2 in such a manner as to be rubbed against the guide portion 18*a*2.

(8) When the sheet portion 22*a* has reached the opening 33, the sheet portion 22*a* collides with the portion β of the toner chamber 18 that is on the lower side of the opening 33, thereby bending toward the temporary toner storage V (see FIG. 14D).

(9) The toner conveying member 22 continues to rotate while the sheet portion 22*a* is bent at the portion β on the lower side of the opening 33, whereby the sheet portion 22*a* returns to the toner chamber 18.

COMPARISON OF EXAMPLES

To verify the toner scooping performance obtained in the configurations according to the above embodiments, some working examples and some comparative examples were prepared.

Comparative Example 1

Known Art

Figure 15:
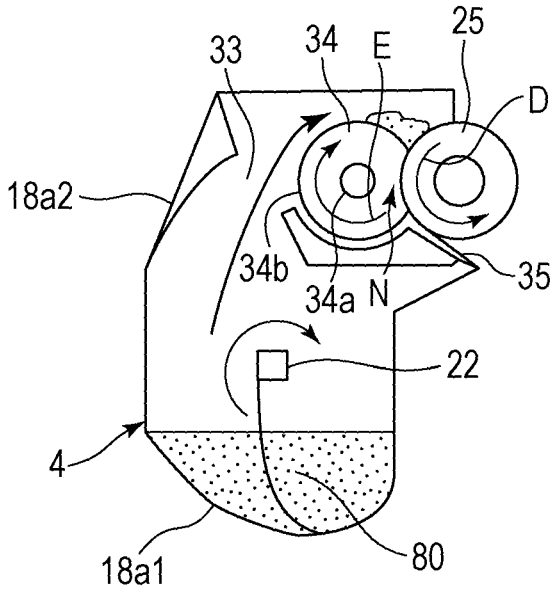
FIG. 15 is a schematic sectional view of a developing device according to Comparative Example 1.

Comparative Example 1 concerns a toner conveying method in which the toner chamber 18 is not thrown by the toner conveying member 22, as in the known art described in Background of the Invention. FIG. 15 is a schematic sectional view of a developing unit 4 according to Comparative Example 1. As illustrated in FIG. 15, the sheet portion 22*a* of the toner conveying member 22 only sweeps along the inner wall of the toner chamber 18 without being deformed. The other details of the developing unit 4 are the same as those described in the second embodiment.

Comparative Example 2

Another Possible Configuration

Figure 16A:
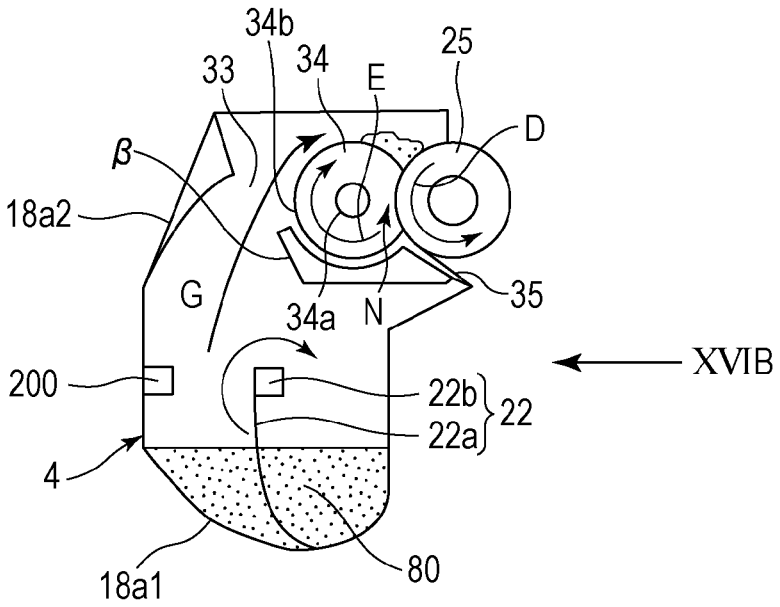
FIGS. 16A and 16B are schematic sectional views of a developing device according to Comparative Example 2.
Figure 16B:
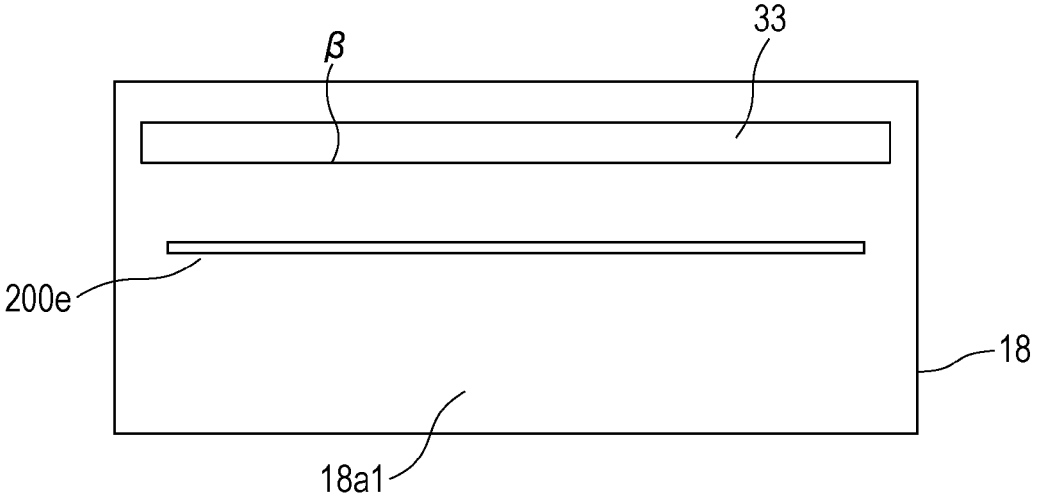

FIG. 16A is a schematic sectional view of a developing unit 4 according to Comparative Example 2. FIG. 16B is another sectional view of the developing unit 4 taken in the longitudinal direction thereof. As illustrated in FIG. 16B, the developing unit 4 has a single projecting portion 200*e* extending continuously in the longitudinal direction. The other details of the developing unit 4 are the same as those described in the second embodiment.

Comparative Example 3

Yet Another Possible Configuration

Figure 17A:
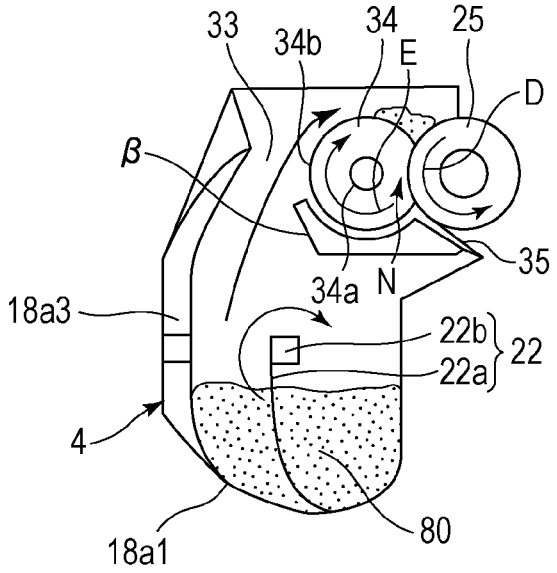
FIGS. 17A and 17B are schematic sectional views of a developing device according to Comparative Example 3.
Figure 17B:
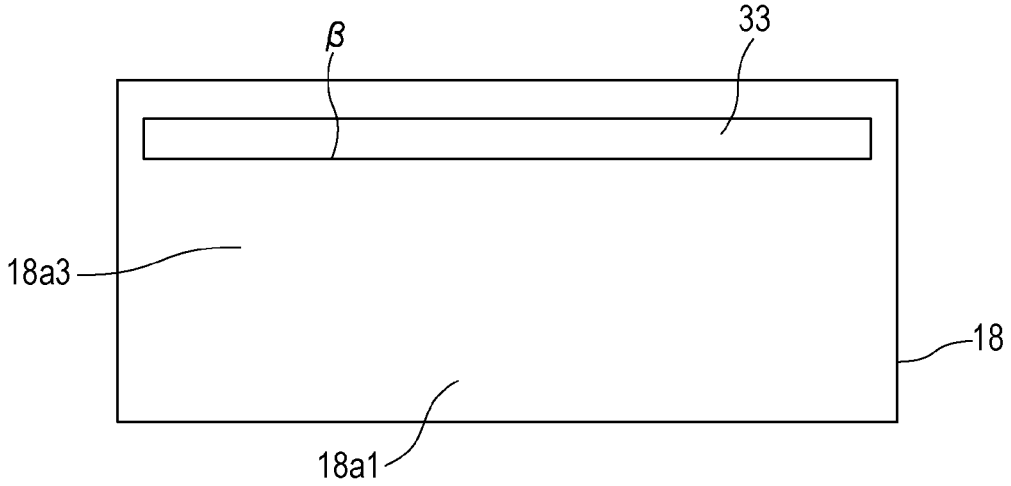

FIG. 17A is a schematic sectional view of a developing unit 4 according to Comparative Example 3. FIG. 17B is another sectional view of the developing unit 4 taken in the longitudinal direction thereof. In Comparative Example 3, as in the known art described in Background of the Invention, a deforming-releasing portion 18*a*3 is provided as a portion of the inner wall of the toner chamber 18. To allow the sheet portion 22*a* of the toner conveying member 22 to be released at the same position as in the second embodiment, the free length of the sheet portion 22*a* is shorter by 10 mm than that of the sheet portion 22*a* according to the second embodiment. The other details of the developing unit 4 are the same as those described in the second embodiment.

Comparative Example 4

Yet Another Possible Configuration

Figure 18A:
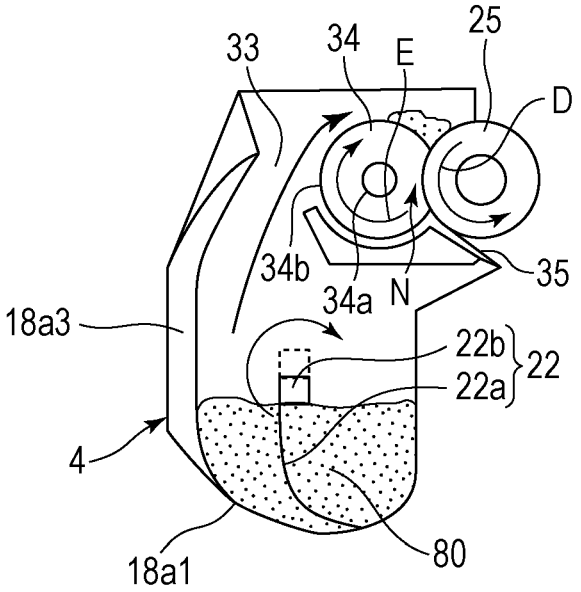
FIGS. 18A and 18B are schematic sectional views of a developing device according to Comparative Example 4.
Figure 18B:
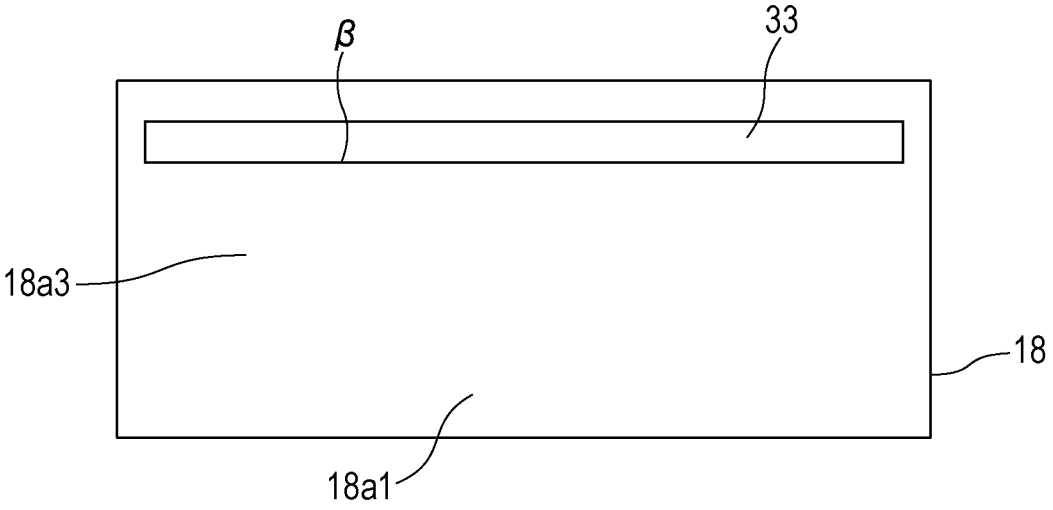

FIG. 18A is a schematic sectional view of a developing unit 4 according to Comparative Example 4. FIG. 18B is another sectional view of the developing unit 4 taken in the longitudinal direction thereof. In Comparative Example 4, as in the known art described in Background of the Invention, a deforming-releasing portion 18*a*3 is provided as a portion of the inner wall of the toner chamber 18. To allow the sheet portion 22*a* to be released at the same position as in the second embodiment, the conveying-member supporting shaft 22*b* of the toner conveying member 22 is provided at a lower position than in the second embodiment. The other details of the developing unit 4 are the same as those described in the second embodiment. That is, the free length of the sheet portion 22*a* is 50 mm as in the second embodiment.

member 22) was measured. The sheet portion 22*a* of the toner conveying member 22 that had been deformed as described below was used in each of the second embodiment and the examples except Comparative Example 1.

To deform the sheet portion 22*a* of the toner conveying member 22 according to each of the second embodiment, Working Examples 1 to 3, and Comparative Examples 1 to 4, each of the developing units 4 was left for ten days in an environment at a temperature of 40° C. and a humidity of 90%, with the sheet portion 22*a* being bent by the projecting portions 200 as illustrated in FIG. 13B. In general, a flexible sheet is deformed when kept pressed for a long time and does not restore its original form thereafter. The flexible sheet is deformed most significantly particularly when kept pressed in a high-temperature environment.

The results of the above verification are summarized in Table 1 below. The second embodiment exhibited good toner scooping performance in each of two cases. Details will be described separately below.

TABLE 1

| | Number of revolutions | | | | | | | |
|---|---|---|---|---|---|---|---|---|
| Amount of toner | 2nd embodiment | Working Example 1 | Working Example 2 | Working Example 3 | Comp. Example 1 | Comp. Example 2 | Comp. Example 3 | Comp. Example 4 |
| 30 g | 15 | 16 | 16 | 15 | Not achieved | 17 | 45 | Not achieved |
| 20 g | 10 | 11 | 11 | 10 | Not achieved | 13 | 30 | Not achieved |

Working Example 1

Figure 19A:
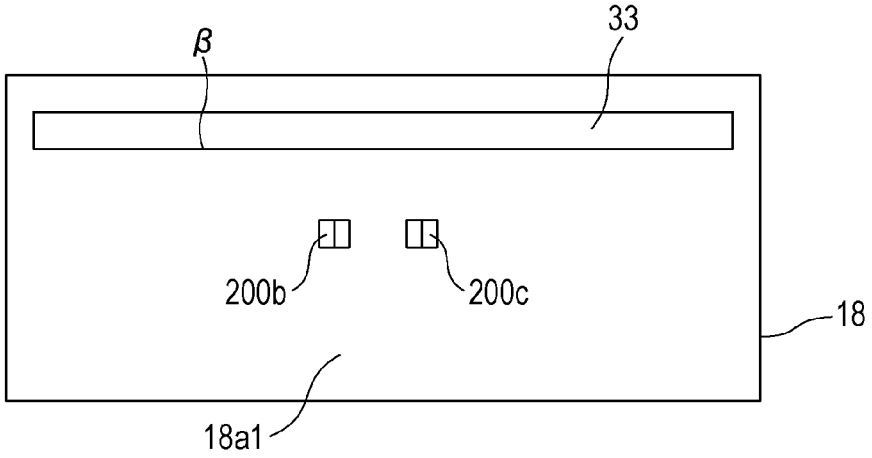
FIGS. 19A to 19C schematically illustrate projecting portions according to Working Examples 1 to 3, respectively.

FIG. 19A illustrates Working Example 1, in which two projecting portions 200*b* and 200*c* are provided at the longitudinal center. The other details are the same as those described in the second embodiment.

Working Example 2

Figure 19B:
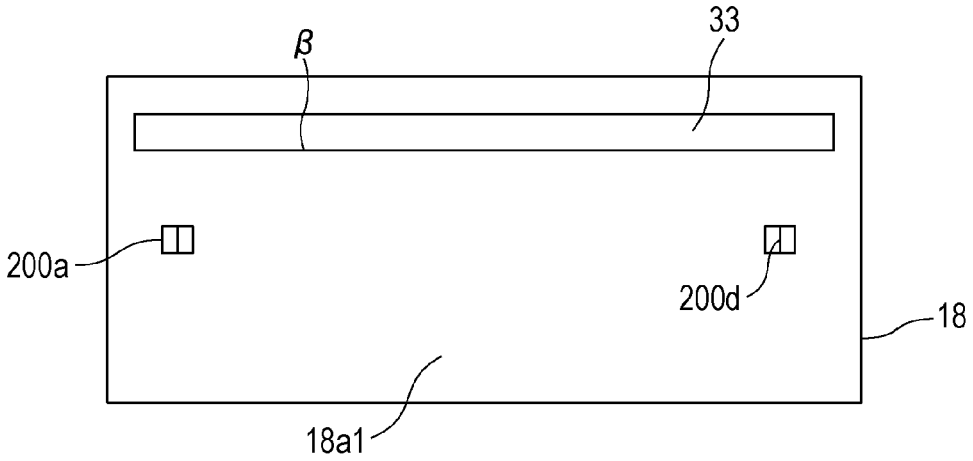

FIG. 19B illustrates Working Example 2, in which two projecting portions 200*a* and 200*d* are provided at the two respective longitudinal ends. The other details are the same as those described in the second embodiment.

Working Example 3

Figure 19C:
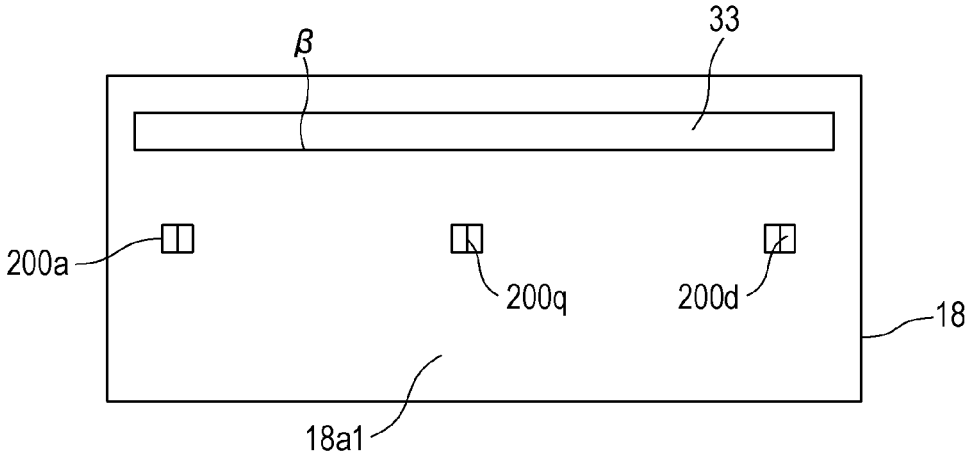

FIG. 19C illustrates Working Example 3, in which three projecting portions 200*a*, 200*q*, and 200*d* are provided at regular intervals in the longitudinal direction. The other details are the same as those described in the second embodiment.

Verification 1: Verification of Toner Scooping Performance

To verify the toner scooping performance, the time elapsed for scooping all the toner 80 in the toner chamber 18 was measured for each of the developing units 4 according to the second embodiment, Working Examples 1 to 3, and Comparative Examples 1 to 4.

Verification Method

Each of the developing units 4 was set in the image forming apparatus 100 according to the first embodiment and was driven without the performance of the image forming operation, in an environment at a temperature of 23° C. and a humidity of 50%. Then, the time elapsed for scooping all the toner 80 stored in the toner chamber 18 into the development chamber (the number of revolutions of the toner conveying Verification 2: Solid-Image-Density-Continuity Test To verify the toner scooping performance, an image density test was conducted for each of the developing units 4 according to the second embodiment, Working Examples 1 to 3, and Comparative Examples 1 to 4.

Verification Method

To verify the capability of supplying toner, a solid-image-density-continuity test was conducted by using the image forming apparatus 100 according to the first embodiment in an environment at a temperature of 23° C. and a humidity of 50%. In this test, the reduction in the image density after continuous high-quality printing was measured. As in Verification 1, the sheet portion 22*a* of the toner conveying member 22 had been deformed in each of the second embodiment and the examples except Comparative Example 1.

First, the image forming apparatus 100 was left for one day in an environment at a temperature of 25° C. and a relative humidity of 50%. Then, the test was conducted after the printing of 100 pages. In the printing of 100 pages, an image including horizontal lines at an image ratio of 5% was printed continuously on letter sheets. After that, a black solid image was printed on three consecutive pages. Then, the difference in the image density between the head and the tail of the black solid image on the third page was evaluated through a spectrodensitometer of 500 series manufactured by X-Rite, Incorporated. The printing and the evaluation were based on monochrome images. The density was measured at a total of three points: at the center of the image, and at two points at 20 mm from the two respective ends of the sheet. Table 2 and 3 below summarizes the results of measurements at the center of the image and at the two ends of the image, respectively. In the measurement at the two ends of the sheet, the worse one of the results obtained at the two points at 20 mm from the right and left ends of the sheet is listed in Table 3.

Criteria

A: The difference in the density of the black solid image between the head and the tail was below 0.2.

B: The difference in the density of the black solid image between the head and the tail was 0.2 or above and below 0.3.

C: The difference in the density of the black solid image between the head and the tail was 0.3 or above.

TABLE 2

| Amount of toner | 2nd embodiment | Working Example 1 | Working Example 2 | Working Example 3 | Comp. Example 1 | Comp. Example 2 | Comp. Example 3 | Comp. Example 4 |
|---|---|---|---|---|---|---|---|---|
| 100 g | A | A | A | A | C | A | A | A |
| 80 g | A | A | A | A | C | A | A | A |
| 60 g | A | A | A | A | C | A | A | B |
| 40 g | A | A | A | A | C | A | B | C |
| 30 g | A | A | A | A | C | B | B | C |
| 20 g | A | A | B | A | C | B | C | C |
| 10 g | A | A | B | A | C | C | C | C |
| 5 g | A | A | C | A | C | C | C | C |

TABLE 3

| Amount of toner | 2nd embodiment | Working Example 1 | Working Example 2 | Working Example 3 | Comp. Example 1 | Comp. Example 2 | Comp. Example 3 | Comp. Example 4 |
|---|---|---|---|---|---|---|---|---|
| 100 g | A | A | A | A | C | A | A | A |
| 80 g | A | A | A | A | C | A | A | A |
| 60 g | A | A | A | A | C | A | A | B |
| 40 g | A | B | A | A | C | A | B | C |
| 30 g | A | B | A | A | C | B | B | C |
| 20 g | A | C | A | A | C | B | C | C |
| 10 g | A | C | B | B | C | C | C | C |
| 5 g | A | C | B | B | C | C | C | C |

Detailed Review of Verifications

First, the superiority of the second embodiment over Comparative Example 1, which is a known art, will be described.

In Comparative Example 1, 20 g of toner was not able to be completely scooped in Verification 1 even after 1000 revolutions.

This is because the toner conveying member 22 directly conveyed the toner without throwing the toner. In this configuration, as the toner held by the toner conveying member 22 approached the opening 33, some of the toner fell off. Hence, the force of scooping the toner into the development chamber was small.

Next, the superiority of the second embodiment over Comparative Example 2 will be described.

Comparative Example 2 employed the projecting portion 200*e* extending continuously in the longitudinal direction. In this configuration, according to the results of Verifications 1 and 2, the capability of scooping the toner was lower than in the second embodiment. This is because the amount of toner holdable by the toner conveying member 22 in Comparative Example 2 was smaller by the volume of the projecting portion 200*e* than in the second embodiment. According to the review, the amount of toner holdable by the toner conveying member 22 in Comparative Example 2 was reduced by the volume of the projecting portion 200*e*, specifically, smaller by 10% by weight than in the second embodiment. Since the projecting portion 200*e* extended continuously in the longitudinal direction, the sheet portion 22*a* of the toner conveying member 22 was brought into contact with the projecting portion 200*e* continuously in the longitudinal direction. Accordingly, the reduction in the amount of toner due to the contact between the sheet portion 22*a* and the projecting portion 200*e* is large.

According to Verification 2, in the case where the amount of toner stored in the toner chamber 18 was large, the toner conveying member 22 was able to hold a satisfactory amount of toner, needless to consider the reduction in the amount of toner holdable. However, as the amount of toner in the toner chamber 18 was reduced, the amount of toner holdable was reduced. In such a situation, the volume of the projecting portions 200 affected the toner scooping performance. Hence, the toner scooping performance was lower than in the second embodiment.

Next, the superiority of the second embodiment over Comparative Example 3 will be described.

In Comparative Example 3, the sheet portion 22*a* having been bent was released by a surface that was continuous with the inner wall of the toner chamber 18. To release the bent sheet portion 22*a* at the same position as in the second embodiment, the free length of the sheet portion 22*a* needs to be reduced while the conveying-member supporting shaft 22*b* of the toner conveying member 22 is unchanged from that of the second embodiment. Hence, the sheet portion 22*a* of the toner conveying member 22 according to Comparative Example 3 was shorter by 10 mm than that employed in the second embodiment. In all of the results of Verifications 1 and 2, the toner scooping performance was lower than in the second embodiment. This is because the amount of toner holdable was reduced by 10% of that of the second embodiment, with the reduction in the free length of the sheet portion 22*a* accompanied by the reduction in the amount of bend in the sheet portion 22*a*.

Next, the superiority of the second embodiment over Comparative Example 4 will be described.

In Comparative Example 4, the sheet portion 22*a* having been bent was released by a surface that was continuous with the inner wall of the toner chamber 18, as in Comparative Example 3. To release the bent sheet portion 22*a* at the same position as in the second embodiment, the center of rotation of the toner conveying member 22 needs to be lowered in the gravitational direction while the free length of the sheet portion 22*a* remains the same as in the second embodiment. Hence, the center of rotation of the toner conveying member 22 according to Comparative Example 4 was lowered by 5 mm from that of the second embodiment. The free length of the sheet portion 22*a* was 50 mm, as in the second embodiment.

In all of the results of Verifications 1 and 2, the toner scooping performance in Comparative Example 4 was lower than in the second embodiment.

This is because the amount of toner holdable was reduced because some of the toner held by the toner conveying member 22 fell off, as in Comparative Example 1.

Working Example 1

In Working Example 1 illustrated in FIG. 19A, the two projecting portions 200*b* and 200*c* were provided at the longitudinal center. Working Example 1 was also superior to the above comparative examples. This is because employing the projecting portions 200 for releasing the bent sheet portion 22*a* maximized the amount of toner holdable by the toner conveying member 22, and the toner was assuredly scooped into the development chamber by the sheet portion 22*a* moving while being rubbed against the inner wall of the toner chamber 18 even after the releasing of the sheet portion 22*a*. However, the toner scooping performance was lower than in the second embodiment.

In Working Example 1, the bend in the central portion of the sheet portion 22*a* was significant, but the bends in the two respective ends of the sheet portion 22*a* were not so significant. Accordingly, the amount of toner held by the toner conveying member 22 was larger in the central portion than at the two ends. That is, the amount of toner held by the toner conveying member 22 varied in the longitudinal direction. Furthermore, since the bend in the toner conveying member 22 was smaller at the two ends than in the central portion, the repulsive force was insufficient, compared with that of the second embodiment.

Working Example 2

In Working Example 2 illustrated in FIG. 19B, the two projecting portions 200*a* and 200*d* were provided at the two respective longitudinal ends.

Working Example 2 was also superior to the above comparative examples. This is because employing the projections 200 for releasing the bent sheet portion 22*a* maximized the amount of toner holdable by the toner conveying member 22, and the toner was assuredly scooped into the development chamber by the sheet portion 22*a* moving while being rubbed against the inner wall of the toner chamber 18 even after the releasing of the sheet portion 22*a*. However, the toner scooping performance was lower than in the second embodiment.

In Working Example 2, the bends at the two ends of the sheet portion 22*a* were significant, but the bend in the central portion of the sheet portion 22*a* was not so significant. Accordingly, the amount of toner held by the toner conveying member 22 was larger at the two ends than in the central portion. That is, the amount of toner held by the toner conveying member 22 varied in the longitudinal direction. Furthermore, since the bend in the sheet portion 22*a* was smaller in the central portion than at the two ends, the repulsive force was insufficient.

Working Example 3

In Working Example 3 illustrated in FIG. 19C, the three projecting portions 200*a*, 200*q*, and 200*d* are provided at regular intervals in the longitudinal direction.

Working Example 3 was also superior to the above comparative examples. This is because employing the projections 200 for releasing the bent sheet portion 22*a* maximized the amount of toner holdable by the toner conveying member 22, and the toner was assuredly scooped into the development chamber by the sheet portion 22*a* moving while being rubbed against the inner wall of the toner chamber 18 even after the releasing of the sheet portion 22*a*. However, the toner scooping performance was lower than in the second embodiment.

This is because of the following reasons. As the amount of toner 80 in the toner chamber 18 was reduced, the volume of the increased number of projecting portions 200 came to affect and reduce the amount of toner holdable by the bent sheet portion 22*a*. Furthermore, in the case where the sheet portion 22*a* is made of resin sheet, creep occurs in the sheet portion 22*a* after a certain period of use. If the amount of creep becomes large, the elastic force is reduced, and so is the repulsive force. That is, when the sheet portion 22*a* caused creep and the amount of toner held by the toner conveying member 22 therefore became small, the difference in the toner scooping performance from the second embodiment was pronounced.

As described above, the developing unit 4 according to the second embodiment exhibited the highest toner scooping performance. According to the review by the present inventors, if areas of the sheet portion 22*a* that are bent by the projecting portions 200 and areas of the sheet portion 22*a* that are bent by the inner wall of the toner chamber 18 are both present in the longitudinal direction, the toner can be conveyed efficiently without a reduction in the amount of toner holdable. After the sheet portion 22*a* has gone over the projecting portions 200, the sheet portion 22*a* rotates while being in contact with the toner chamber 18. Therefore, the toner can be assuredly conveyed, regardless of the occurrence of creep in the sheet portion 22*a*. Consequently, the toner in the toner chamber 18 can continue to be scooped up stably to the temporary toner storage V, regardless of the amount of toner in the toner chamber 18 and the occurrence of creep in the sheet portion 22*a*.

Although the second embodiment exhibited the best results under the above conditions, a configuration including a more number of or a fewer number of projecting portions 200 than in the second embodiment may exhibit better results, depending on conditions.

Third Embodiment

Other embodiments of the present invention will now be described. A third embodiment of the present invention has many features that are common to the second embodiment. Hence, the following description focuses on the differences from the second embodiment, and redundant description is therefore omitted.

Figure 20:
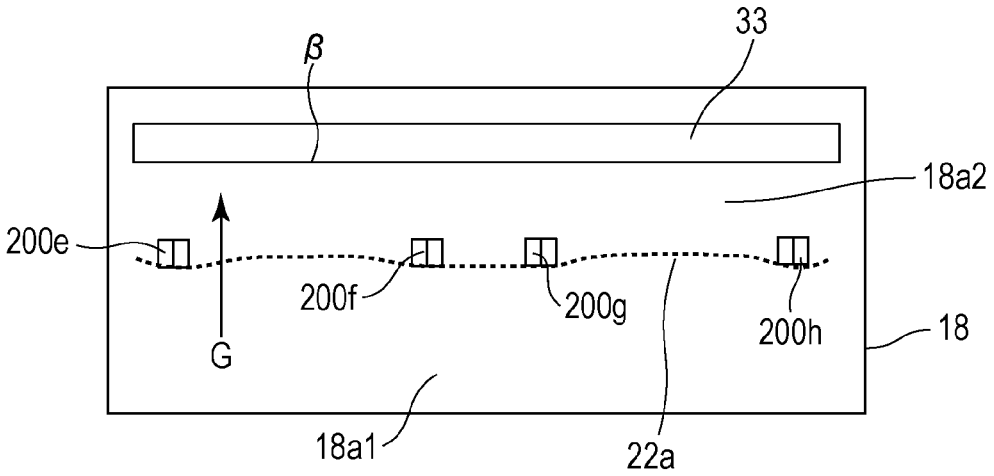
FIG. 20 schematically illustrates projecting portions according to a third embodiment.

FIG. 20 is a longitudinal sectional view of a developing unit 4 according to the third embodiment. The third embodiment differs from the second embodiment in that the projecting portions 200 arranged side by side in the longitudinal direction have different heights. One of the group of first projecting portions and the group of second projecting portions project closer to the conveying-member supporting shaft 22*b* than the other. The sheet portion 22*a* is bent more significantly in areas at a first projecting portion 200*e*, a second projecting portion 200*f*, a third projecting portion 200*g*, and a fourth projecting portion 200*h* than in the other areas (areas facing the inner wall of the toner chamber 18 that do not have the projecting portions 200). The first projecting portion 200*e* and the fourth projecting portion 200*h* each have a height of 10 mm. The second projecting portion 200*f* and the third projecting portion 200*g* each have a height of 5 mm. Therefore, the sheet portion 22*a* is bent more significantly at the first projecting portion 200*e* and the fourth projecting portion 200*h* than at the second projecting portion 200*f* and the third projecting portion 200*g*.

By varying the heights of the projecting portions 200 that are arranged side by side in the longitudinal direction of the toner chamber 18, the amount of toner to be scooped can be varied in the longitudinal direction. Accordingly, the way the toner circulates in the toner chamber 18 can be varied in the longitudinal direction. Such a feature is effective in varying the way the toner circulates in the longitudinal direction in accordance with the characteristics of the developing unit 4. For example, if toner supply failure tends to occur at the two ends of the developing unit 4, a larger amount of toner can be supplied to the two ends of the developing unit 4.

In the third embodiment, as in the second embodiment, areas of the sheet portion 22*a* that are bent by the projecting portions 200 and areas of the sheet portion 22*a* that are bent by the inner wall of the toner chamber 18 are both present in the longitudinal direction. Therefore, the toner can be conveyed efficiently without a reduction in the amount of toner holdable. After the sheet portion 22*a* has gone over the projecting portions 200, the sheet portion 22*a* rotates while being in contact with the toner chamber 18. Therefore, the toner can be assuredly conveyed, regardless of the occurrence of creep in the sheet portion 22*a*. Consequently, the toner in the toner chamber 18 can continue to be scooped up stably to the temporary toner storage V, regardless of the amount of toner in the toner chamber 18 and the occurrence of creep in the sheet portion 22*a*.

Fourth Embodiment

Figure 21:
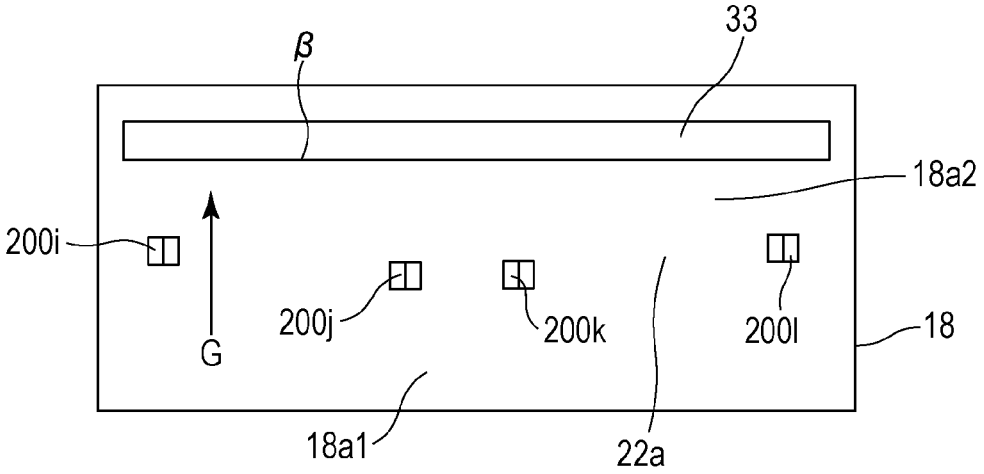
FIG. 21 schematically illustrates projecting portions according to a fourth embodiment.

FIG. 21 is a longitudinal sectional view of a developing unit 4 according to a fourth embodiment of the present invention. The fourth embodiment differs from the second embodiment in that the projecting portions 200 are arranged at different positions in the longitudinal direction and in a staggered manner with respect to a virtual line extending in the longitudinal direction. In the fourth embodiment, a first projecting portion 200*i* and a fourth projecting portion 200*l* are provided in a horizontal plane containing the conveying-member supporting shaft 22*b* of the toner conveying member 22. In such a situation, the first and fourth projecting portions 200*i* and 200*l* are also regarded as being on a line extending in the longitudinal direction of the toner chamber 18. On the other hand, a second projecting portion 200*j* and a third projecting portion 200*k* are each provided 5 mm below, in the gravitational direction, the horizontal plane containing the conveying-member supporting shaft 22*b* of the toner conveying member 22. In such a situation, the second and third projecting portions 200*j* and 200*k* are also regarded as each being 5 mm apart from the above horizontal plane in the gravitational direction that intersects the line extending in the longitudinal direction of the toner chamber 18. The projecting portions 200 all have a height of 5 mm, which is the same as in the second embodiment. When the toner conveying member 22 rotates, the sheet portion 22*a* starts to be bent by the second projecting portion 200*j* and the third projecting portion 200*k*. When the toner conveying member 22 further rotates, the sheet portion 22*a* is bent by coming into contact with the first projecting portion 200*i* and the fourth projecting portion 200*l* while being bent further by the second projecting portion 200*j* and the third projecting portion 200*k*. That is, the sheet portion 22*a* is bent more significantly by the second projecting portion 200*j* and the third projecting portion 200*k*.

As described above, if the positions of the projecting portions 200 are staggered with respect to the line extending in the longitudinal direction, the amount of toner scooped can be varied in the longitudinal direction.

In the fourth embodiment, as in the second embodiment, areas of the sheet portion 22*a* that are bent by the projecting portions 200 and areas of the sheet portion 22*a* that are bent by the inner wall of the toner chamber 18 are both present in the longitudinal direction. Therefore, the toner can be conveyed efficiently without a reduction in the amount of toner holdable.

Fifth Embodiment

Figure 22A:
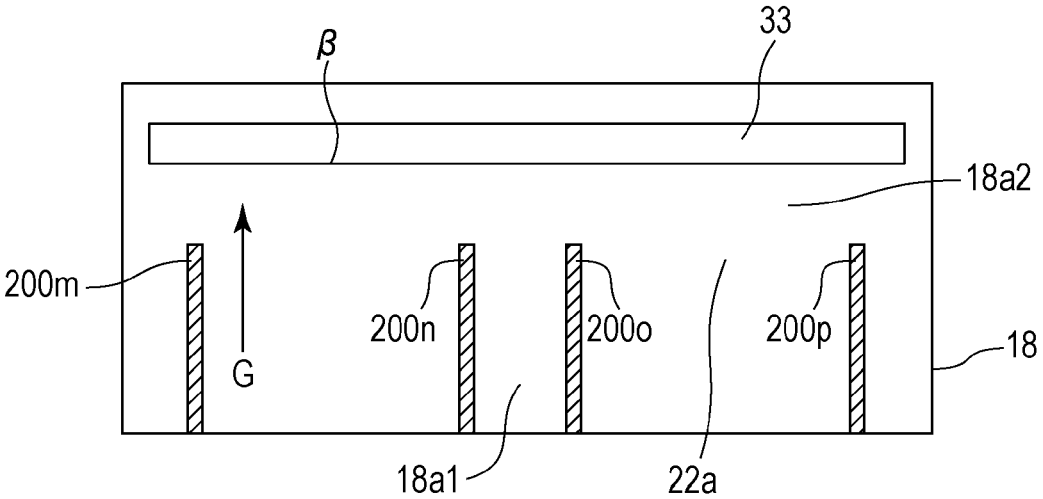
FIGS. 22A and 22B schematically illustrates projecting portions according to a fifth embodiment.
Figure 22B:
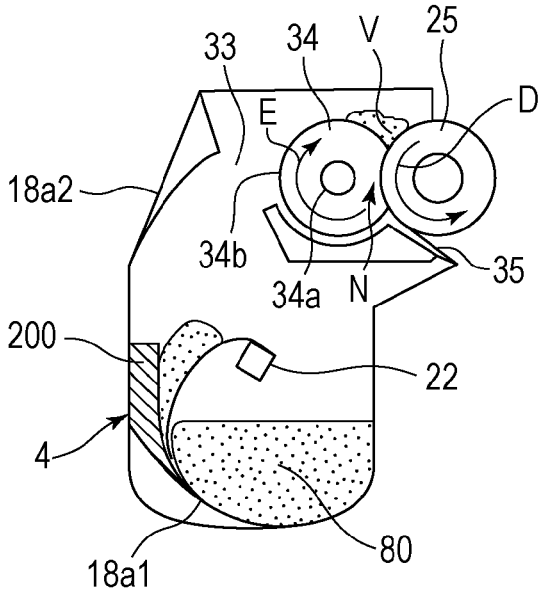

In a fifth embodiment of the present invention, as illustrated in FIGS. 22A and 22B, projecting portions 200*m*, 200*n*, 200*o*, and 200*p* are each provided as a rib whose length of projection gradually increases from the bottom of the toner chamber 18. Since the shape of such a projecting portion 200 changes continuously, the toner can be held more stably than in a case where the projecting portion 200 suddenly appears.

The rib may be, in sectional view, in any of surface contact, line contact, and point contact with the sheet portion 22*a*, as in the second embodiment. Moreover, the rib may have a curved tip, as long as the rib can bend the sheet portion 22*a* by a desired amount.

As in the second embodiment, the moment that the sheet portion 22*a* has gone out of contact with the terminal ends of the ribs, the sheet portion 22*a* having an elastic force collides with the portion β of the toner chamber 18 that is on the lower side of the opening 33 after being rubbed against the guide portion 18*a*2.

As described above, the sheet portion 22*a* comes into contact with the guide portion 18*a*2. Therefore, even if the sheet portion 22*a* has creep (deformation) as illustrated in FIG. 14B, some toner that cannot be thrown by the crept portion can be held between the sheet portion 22*a* and the inner wall of the toner chamber 18.

In the fifth embodiment, as in the second embodiment, areas of the sheet portion 22*a* that are bent by the projecting portions 200 and areas of the sheet portion 22*a* that are bent by the inner wall of the toner chamber 18 are both present in the longitudinal direction. Therefore, the toner can be conveyed efficiently without a reduction in the amount of toner holdable.

Sixth Embodiment

Figure 23:
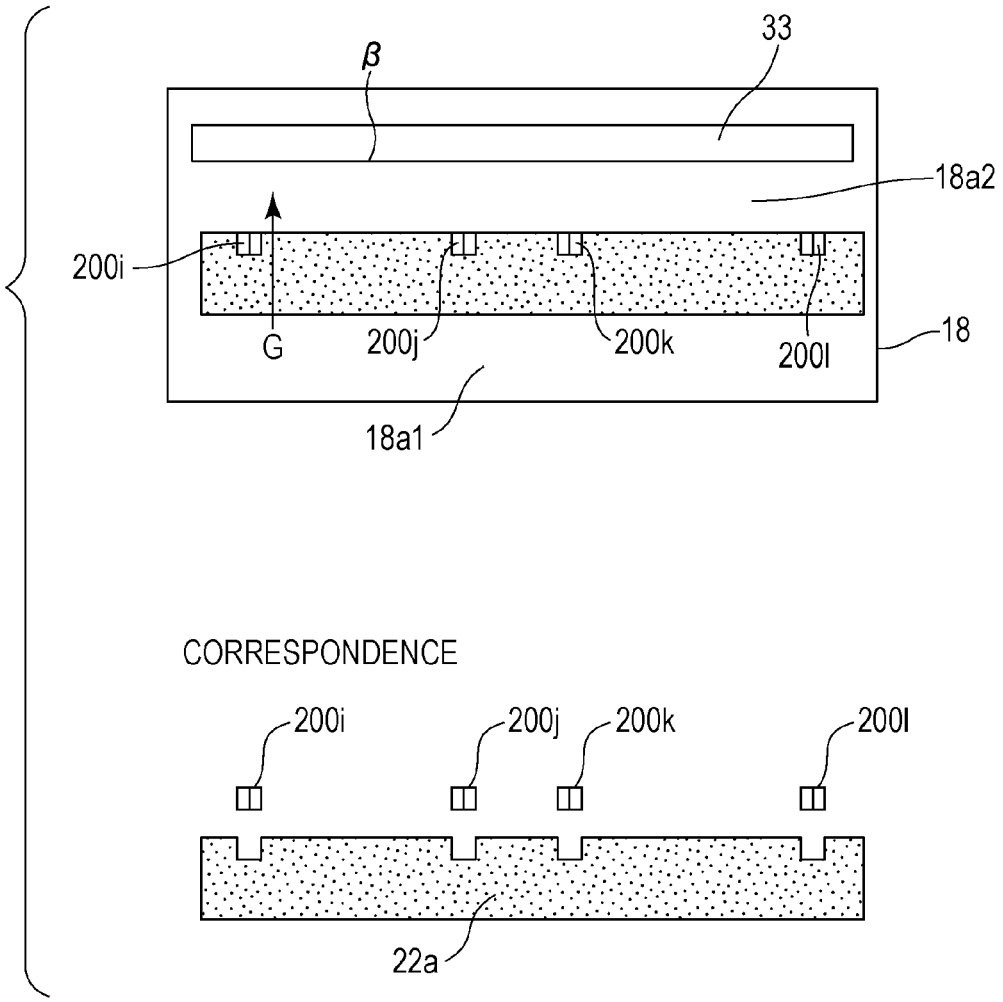
FIG. 23 schematically illustrates projecting portions according to a sixth embodiment.

A sixth embodiment of the present invention differs from the second embodiment in that the sheet portion 22*a* has recesses provided in correspondence with the projecting portions 200. FIG. 23 schematically illustrates the correspondence between the recesses of the sheet portion 22*a* and projecting portions 200*i*, 200*j*, 200*k*, and 200*l*. Providing the recesses at the free end of the sheet portion 22*a* in correspondence with the projecting portions 200 optimizes the way the sheet portion 22*a* is bent at the boundary between each of the areas of the sheet portion 22*a* that face the projecting portions 200 and an area of the sheet portion 22*a* that is adjacent thereto. Therefore, the amount of toner holdable is increased.

FIG. 23 illustrates how the recesses are provided in the thickness direction of the sheet portion 22*a*. The timing of contact between the projecting portions 200 and the sheet portion 22*a* having the recesses is delayed with respect to the timing of contact between the projecting portions 200 and the sheet portion 22*a* not having the recesses. Thus, the amount of bend in areas at the free end of the sheet portion 22*a* that are not in contact with the projecting portions 200 and the amount of bend in areas at the free end of the sheet portion 22*a* that are in contact with the projecting portions 200 can be adjusted so that the difference in the amount of bend between the state illustrated in FIG. 13B and the state illustrated in FIG. 13C can be reduced. Consequently, the amount of toner conveyed is evened out in the longitudinal direction.

As in the second embodiment, the moment that the sheet portion 22*a* has gone out of contact with the terminal ends of the ribs, the sheet portion 22*a* having an elastic force collides with the portion β of the toner chamber 18 that is on the lower side of the opening 33 after being rubbed against the guide portion 18*a*2.

In the sixth embodiment, as in the second embodiment, areas of the sheet portion 22*a* that are bent by the projecting portions 200 and areas of the sheet portion 22*a* that are bent by the inner wall of the toner chamber 18 are both present in the longitudinal direction. Therefore, the toner can be conveyed efficiently without a reduction in the amount of toner holdable.

Seventh Embodiment

Figure 24:
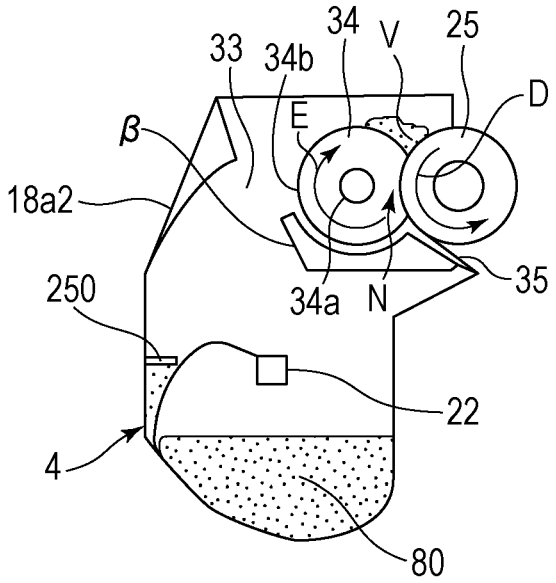
FIG. 24 schematically illustrates projecting portions according to a seventh embodiment.

As illustrated in FIG. 24, a developing unit 4 according to a seventh embodiment of the present invention has sheets 250 instead of the projecting portions 200 according to the second embodiment. The sheets 250 are pasted to the inner wall of the toner chamber 18. Thus, the volume of members corresponding to the projecting portions 200 is greatly reduced. Accordingly, the amount of toner holdable by the toner conveying member 22 is maximized. The sheets 250 may be made of any material that is capable of bending the sheet portion 22*a*. The arrangement of the sheets 250, the level at which the sheets 250 are provided, and other details are the same as those described for the projecting portions 200 in the second embodiment.

In the seventh embodiment, as in the second embodiment, areas of the sheet portion 22*a* that are bent by the projecting portions 200 and areas of the sheet portion 22*a* that are bent by the inner wall of the toner chamber 18 are both present in the longitudinal direction. Therefore, the toner can be conveyed efficiently without a reduction in the amount of toner holdable.

Eighth Embodiment

In an eighth embodiment of the present invention, the projecting portions 200 illustrated in FIG. 12 are made of an elastic material. Giving elasticity to the projecting portions 200 reduces the physical friction with respect to the sheet portion 22*a*.

The elastic material forming the projecting portions 200 may be any material that is capable of bending the sheet portion 22*a* by a desired amount. In the eighth embodiment, urethane rubber is used. The arrangement of the projecting portions 200 and other details are the same as those of the second embodiment.

Ninth Embodiment

Figure 25:
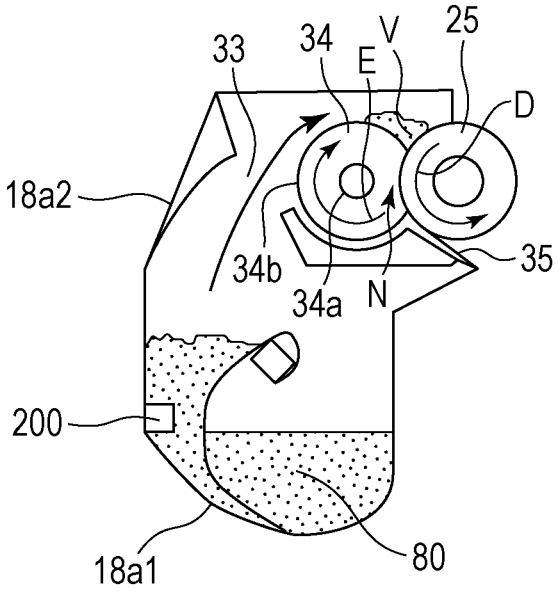
FIG. 25 schematically illustrates projecting portions according to an eighth embodiment.

In the second embodiment described above, the projecting portions 200 are provided in a horizontal plane containing the conveying-member supporting shaft 22*b*. A ninth embodiment of the present invention illustrated in FIG. 25 differs from the second embodiment in that the projecting portions 200 are provided below the horizontal plane in the gravitational direction. Since the projecting portions 200 are provided below the horizontal plane, the amount of toner holdable is increased. Therefore, unless the amount of bend in the sheet portion 22*a* is increased, the sheet portion 22*a* may be deformed by the weight of the toner, failing in scooping the toner. To avoid such a situation, the thickness and the free length of the sheet portion 22*a* are made different from those of the second embodiment. In the ninth embodiment, the sheet portion 22*a* has a thickness of 400 μm and a free length of 105 mm. The length of the guide portion 18*a*1 is substantially the same as the free length of the sheet portion 22*a*. In the ninth embodiment, the running torque of the toner conveying member 22 is larger than in the second embodiment. Therefore, the driving motor of the image forming apparatus (not illustrated) is changed to a high-power motor.

In the ninth embodiment, as in the second embodiment, areas of the sheet portion 22*a* that are bent by the projecting portions 200 and areas of the sheet portion 22*a* that are bent by the inner wall of the toner chamber 18 are both present in the longitudinal direction. Therefore, the toner can be conveyed efficiently without a reduction in the amount of toner holdable.

While the embodiments described above each concern an image forming apparatus that is capable of forming a color image, the present invention is not limited to such a case and may concern an image forming apparatus that is capable of forming a monochrome image. The present invention is applicable to a developer container, a developing device, and so forth that are each attachable to and detachable from such an image forming apparatus.

While the above embodiments each concern a case where the image forming apparatus is a printer, the present invention is not limited to such a case. For example, the present invention is also applicable to any of other image forming apparatuses such as a copier and a facsimile, or a multifunction apparatus having the functions of such apparatuses. Moreover, the present invention is applicable to an image forming apparatus that uses another image forming apparatus and a recording-medium-carrying member and transfers toner images in different colors to a recording medium on the recording-medium-carrying member such that the toner images are superposed one on top of another on the recording medium.

While the above embodiments each concern a case where a single sheet portion 22*a* as a stirring member is provided to the conveying-member supporting shaft 22*b*, the present invention is not limited to such a case. The same advantageous effects are produced in a case where a plurality of sheet members 22*a* are provided to the conveying-member supporting shaft 22*b*.

While the above embodiments each concern a contact development method employing nonmagnetic single-component toners, the present invention is not limited thereto. The same advantageous effects are produced by a jumping development method.

As described above, according to each of the embodiments of the present invention, the reduction in the amount of developer to be held by the conveying member can be suppressed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-052325, filed Mar. 14, 2014, Japanese Patent Application No. 2014-074543, filed Mar. 31, 2014, and Japanese Patent Application No. 2015-004825, filed Jan. 14, 2015, which are hereby incorporated by reference herein in their entirety.

What is claimed is:

1. A developer container comprising:

a storage chamber that stores developer;

a conveying member provided in the storage chamber and configured to convey the developer;

a transmitting member configured to transmit a signal for detecting an amount of developer; and a first projecting portion provided on an inner sidewall of the storage chamber, the first projecting portion projecting toward a side of a conveying-member shaft of the conveying member when seen in a longitudinal direction of the storage chamber and being different from the transmitting member, wherein the transmitting member includes a second projecting portion projecting from the inner sidewall of the storage chamber toward a side of the conveying-member shaft of the conveying member when seen in the longitudinal direction of the storage chamber, and wherein the conveying member is deformed elastically by coming into contact with one of the first projecting portion and the second projecting portion while being in contact with the other projecting portion by which the conveying member has already been elastically deformed, or the conveying member is deformed elastically by simultaneously coming into contact with the first projecting portion and the second projecting portion.

2. The developer container according to claim 1, wherein the first projecting portion includes a plurality of projecting portions.

3. The developer container according to claim 2, wherein the second projecting portion is provided between each adjacent two of the first projecting portions.

4. The developer container according to claim 1, wherein the first projecting portion and the second projecting portion are arranged in the longitudinal direction of the storage chamber.

5. The developer container according to claim 1, wherein the first projecting portion extends in the longitudinal direction of the storage chamber.

6. The developer container according to claim 1, wherein the second projecting portion includes a plurality of projecting portions.

7. The developer container according to claim 1, wherein the first projecting portion has the same shape as the second projecting portion when seen in the longitudinal direction of the storage chamber.

8. The developer container according to claim 1, wherein, in a state where the developer container is set in an image forming apparatus, the first projecting portion is positioned above the conveying-member shaft of the conveying member in a vertical direction.

9. The developer container according to claim 1, wherein the transmitting member transmits light.

10. A developing device comprising:

the developer container according to claim 1; and a developer bearing member that carries the developer received from the conveying member.

11. The developing device according to claim 10, wherein, in a state where the developing device is set in an image forming apparatus, the developer bearing member is positioned above the conveying member.

12. A process cartridge comprising:

the developer container according to claim 1; and an image bearing member that carries a latent image to be developed with the developer.

13. An image forming apparatus comprising:

the developer container according to claim 1 that is attachable to and detachable from the image forming apparatus, wherein the image forming apparatus forms an image on a recording medium by using the developer.

14. A developer container comprising:

a storage chamber that stores developer;

a development chamber into which the developer is supplied from the storage chamber through an opening;

a conveying member provided in the storage chamber and configured to convey the developer; and a projecting portion, which includes a first projecting portion and a second protecting portion closer to a rotating shaft of the conveying member than the first projecting portion, projecting from an inner sidewall of the storage chamber toward a rotating-shaft side of the conveying member when seen in a longitudinal direction of the storage chamber, wherein a free end of the conveying member comes into contact with a wall of the storage chamber when positioned on a downstream side with respect to the projecting portion and on an upstream side with respect to the opening in a direction of rotation of the conveying member, wherein the conveying member bends by coming into contact with the projecting portion and conveys the developer when being released from the projecting portion, and wherein a velocity vector at a free end of the conveying member and in a direction opposite to a gravitational direction becomes largest during a period after the free end that has been bent is released from the projecting portion and before the free end comes into contact with the storage chamber.

15. The developer container according to claim 14, wherein the free end of the conveying member is in contact with the wall of the storage chamber during a period from when the conveying member that has been bent is released from the projecting portion until when the conveying member conveys the developer to the opening.

16. The developer container according to claim 14, wherein, in a case where a rotating shaft of the conveying member is positioned in a horizontal plane that is orthogonal to the gravitational direction, the projecting portion is positioned in or below the horizontal plane in the gravitational direction.

17. The developer container according to claim 14, wherein the conveying member includes a rotating shaft, and wherein a radius of rotation of the conveying member is longer than a first distance from the rotating shaft to the wall of the storage chamber with which the free end of the conveying member is in contact.

18. The developer container according to claim 17, wherein a relationship among positions of the rotating shaft of the conveying member, the free end of the conveying member, and the wall of the storage chamber is expressed as follows:

$$0.0\ \text{mm} < (\text{radius of rotation} - \text{first distance}) < 2.5\ \text{mm}.$$

19. The developer container according to claim 14, wherein the first projecting portion and the second projecting portion are provided at different positions in the longitudinal direction of the storage chamber.

20. The developer container according to claim 19, wherein the first projecting portion and the second projecting portion are provided on a single virtual line extending in the longitudinal direction of the storage chamber, or wherein the first projecting portion and the second projecting portion are provided at respective positions staggered in the gravitational direction.

21. The developer container according to claim 14, wherein at least one of the first projecting portion and the second projecting portion has elasticity.

22. The developer container according to claim 14, wherein the conveying member includes a sheet member, and wherein the sheet member has a plurality of recesses on a side of the free end.

23. A developing device comprising:

the developer container according to claim 14; and a developer bearing member that carries the developer, wherein the development chamber is positioned above the storage chamber.

24. A process cartridge comprising:

the developer container according to claim 14; and an image bearing member that carries a latent image to be developed with the developer.

25. An image forming apparatus comprising:

the developer container according to claim 14 that is attachable to and detachable from the image forming apparatus, wherein an image is formed on a recording medium with the developer.

* * * * *